US010745934B2

(12) United States Patent
Choi

(10) Patent No.: US 10,745,934 B2
(45) Date of Patent: Aug. 18, 2020

(54) EAVE STRUCTURE AND TENT FRAME HAVING SAME

(71) Applicant: Campvalley (Xiamen) Co. Ltd., Xiamen (CN)

(72) Inventor: Kwan Jun Choi, Xiamen (CN)

(73) Assignee: Campvalley (Xiamen) Co., Ltd., Xiamen (CN)

( * ) Notice: Subject to any disclaimer, the term of this patent is extended or adjusted under 35 U.S.C. 154(b) by 0 days.

(21) Appl. No.: 16/380,875

(22) Filed: Apr. 10, 2019

(65) Prior Publication Data

US 2019/0234100 A1 Aug. 1, 2019

Related U.S. Application Data

(62) Division of application No. 15/782,726, filed on Oct. 12, 2017, now abandoned.

(30) Foreign Application Priority Data

Oct. 13, 2016 (CN) ..... 2016 2 1118083 U
Dec. 20, 2016 (CN) ..... 2016 2 1407062 U

(51) Int. Cl.

| | |
|---|---|
| ***E04H 15/50*** | (2006.01) |
| ***E04H 15/48*** | (2006.01) |
| ***E04H 15/46*** | (2006.01) |
| *E04H 15/64* | (2006.01) |
| *E04H 15/54* | (2006.01) |

(52) U.S. Cl.

CPC ..... *E04H 15/50* (2013.01); *E04H 15/46* (2013.01); *E04H 15/48* (2013.01); *E04H 15/54* (2013.01); *E04H 15/64* (2013.01)

(58) Field of Classification Search

CPC ..... E04H 15/50; E04H 15/46

See application file for complete search history.

(56) References Cited

U.S. PATENT DOCUMENTS 1,061,547 A 5/1913 Kennedy
1,347,107 A 7/1920 McCann
(Continued)

FOREIGN PATENT DOCUMENTS

CA 2895981 A1 12/2015
CN 2401649 Y 10/2000
(Continued)

*Primary Examiner* — Noah Chandler Hawk
(74) *Attorney, Agent, or Firm* — Morgan, Lewis & Bockius LLP

(57) ABSTRACT

Disclosed are eave structures and tent frames. A tent frame includes a supporting pole, a fixed connector fixedly coupled with an upper end portion of the supporting pole and at least one sliding connector slidably coupled with the supporting pole and movable along the supporting pole below the fixed connector. An eave structure includes first and primary eave poles, each having a first end pivotally connected with the fixed connector. An eave structure also includes first and second support eave poles, each having a first end pivotally connected with the at least one sliding connector and a second end pivotally connected with the corresponding first or second primary eave pole. When the tent frame is unfolded, the first and second primary eave poles extend outwardly and upwardly with respect to the supporting pole, and form a first angle in-between.

20 Claims, 25 Drawing Sheets

(56) References Cited

U.S. PATENT DOCUMENTS

| | | | | |
|---|---|---|---|---|
| 1,846,011 | A * | 2/1932 | Adams | E04H 15/48 135/158 |
| 3,888,056 | A | 6/1975 | Kelly | |
| 4,286,612 | A | 9/1981 | Neal | |
| 4,630,627 | A | 12/1986 | Windows | |
| 4,641,676 | A | 2/1987 | Lynch | |
| 4,793,371 | A | 12/1988 | O'Ferrell | |
| 4,944,321 | A | 7/1990 | Moyet-Ortiz | |
| 5,224,507 | A | 7/1993 | Vosse | |
| 5,275,188 | A | 1/1994 | Tsai | |
| 5,421,356 | A | 6/1995 | Lynch | |
| 5,794,640 | A | 8/1998 | Jang | |
| 5,813,425 | A | 9/1998 | Carter | |
| 5,944,040 | A | 8/1999 | Jang | |
| 6,182,917 | B1 | 2/2001 | Lai | |
| 6,206,020 | B1 | 3/2001 | Lynch | |
| 6,463,948 | B2 | 10/2002 | Lee | |
| 6,598,614 | B2 | 7/2003 | Liu | |
| 6,708,707 | B2 | 3/2004 | Dotterweich | |
| 6,718,995 | B2 | 4/2004 | Dotterweich | |
| 6,848,461 | B2 | 2/2005 | Tsai | |
| 6,929,017 | B2 | 8/2005 | Byun | |
| 7,055,538 | B2 | 6/2006 | Deng | |
| 7,240,686 | B2 | 7/2007 | Seo | |
| 7,296,584 | B2 | 11/2007 | Goldwitz | |
| 7,299,813 | B2 | 11/2007 | Ochi | |
| 7,316,239 | B2 | 1/2008 | Yang | |
| 7,360,549 | B2 | 4/2008 | Seo | |
| 7,395,830 | B2 | 7/2008 | Seo | |
| 7,422,026 | B2 | 9/2008 | Kim | |
| 7,775,229 | B2 * | 8/2010 | Sy-Facunda | E04H 15/48 135/117 |
| 8,220,477 | B2 | 7/2012 | Park | |
| 8,616,226 | B2 | 12/2013 | Ma | |
| 8,701,692 | B2 | 4/2014 | Holland | |
| D705,884 | S | 5/2014 | Jin | |
| 8,776,816 | B2 | 7/2014 | Danziger | |
| 8,893,737 | B2 | 11/2014 | Yang | |
| 8,910,648 | B2 | 12/2014 | Jin | |
| 9,243,422 | B2 | 1/2016 | Hunt | |
| 9,410,341 | B1 * | 8/2016 | Welch | E04H 4/108 |
| 9,528,292 | B1 | 12/2016 | Lovley, II | |
| 9,580,929 | B2 | 2/2017 | Ma | |
| 9,739,073 | B2 | 8/2017 | Huang | |
| 9,869,110 | B2 | 1/2018 | Krenzel | |
| 9,926,720 | B2 | 3/2018 | Huang | |
| 2001/0050098 | A1 | 12/2001 | Lee | |
| 2002/0074032 | A1 | 6/2002 | Park | |
| 2004/0144412 | A1 | 7/2004 | Tsai | |
| 2005/0241688 | A1 | 11/2005 | Wu | |
| 2006/0169312 | A1 | 8/2006 | Choi | |
| 2007/0012347 | A1 | 1/2007 | Ochi | |
| 2007/0051397 | A1 | 3/2007 | Choi | |
| 2007/0144572 | A1 | 6/2007 | Patel | |
| 2007/0221262 | A1 | 9/2007 | Tsai | |
| 2009/0032079 | A1 | 2/2009 | Choi | |
| 2010/0043856 | A1 | 2/2010 | Park | |
| 2011/0073148 | A1 | 3/2011 | Choi | |
| 2012/0291830 | A1 | 11/2012 | Crimi | |
| 2013/0014794 | A1 | 1/2013 | Jin | |
| 2013/0247948 | A1 | 9/2013 | Lovley et al. | |
| 2013/0284225 | A1 | 10/2013 | Holland et al. | |
| 2014/0174491 | A1 | 6/2014 | Yang | |
| 2014/0261601 | A1 | 9/2014 | Jin | |
| 2014/0261602 | A1 | 9/2014 | Ampoyo | |
| 2014/0290710 | A1 | 10/2014 | Choi | |
| 2015/0083177 | A1 | 3/2015 | Hotes | |
| 2015/0247339 | A1 | 9/2015 | Lee | |
| 2015/0308147 | A1 | 10/2015 | Lee | |
| 2015/0376913 | A1 | 12/2015 | Choi | |
| 2016/0108639 | A1 | 4/2016 | Huang | |
| 2016/0348392 | A1 | 12/2016 | Jin | |
| 2017/0121999 | A1 | 5/2017 | Ma | |
| 2017/0292287 | A1 | 10/2017 | Lovley, II | |
| 2018/0080242 | A1 | 3/2018 | Choi | |
| 2018/0080243 | A1 | 3/2018 | Choi | |
| 2018/0106066 | A1 | 4/2018 | Choi | |
| 2018/0106067 | A1 | 4/2018 | Choi | |
| 2018/0106068 | A1 | 4/2018 | Choi | |
| 2018/0142493 | A1 | 5/2018 | Choi | |

FOREIGN PATENT DOCUMENTS

| | | | |
|---|---|---|---|
| CN | 201202302 | Y | 4/2009 |
| CN | 103590650 | B | 2/2014 |
| CN | 104358468 | A | 2/2015 |
| CN | 204163467 | U | 2/2015 |
| CN | 104265063 | A | 7/2015 |
| FR | 1 121 851 | | 8/1956 |
| FR | 68588 | | 5/1958 |
| JP | 4557885 | B2 | 6/2010 |
| WO | WO 2010/104939 | A1 | 9/2010 |
| WO | WO 2011/022764 | A1 | 3/2011 |
| WO | WO 2013/116545 | A1 | 8/2013 |

* cited by examiner

EAVE STRUCTURE AND TENT FRAME HAVING SAME

CROSS-REFERENCE(S) TO RELATED APPLICATIONS

This application is a divisional application of U.S. application Ser. No. 15/782,726, filed Oct. 12, 2017, which claims priority to Chinese Patent Application No. 201621118083.5 filed on Oct. 13, 2016, and priority to Chinese Patent Application No. 201621407062.5 filed on Dec. 20, 2016, the entire contents of which are incorporated herein for all purposes by this reference.

FIELD OF THE INVENTION

The present disclosure relates to tent frames, and, more particularly, the present disclosure relates to eave structures and tent frames having the same.

BACKGROUND

In general, tents are available in a variety of sizes and structures. Small to medium sized tents are typically utilized for mobility and camping, while larger pavilion sized tents provide large shaded regions.

Conventional tents comprise supporting poles, an upper frame supported by the supporting poles and a tent cloth covering the upper frame. The given shaded region of the tent is proportional to an area formed by the tent cloth. Increasing the shaded region requires an enlargement of the tent frame, including increasing a length of the frame poles. The increased size of the frame poles requires auxiliary support to ensure the stability of the tent, thus a weight of the tent increases.

Another means to provide a larger shaded region is to include an eave structure with the tent frame. FIG. 1 and FIG. 2 illustrate an existing tent including eave structure 2*a* disposed on each supporting pole 1*a*. Eave structure 2*a* includes primary eave pole 21*a* and support eave pole 22*a*. A first end portion of primary eave pole 21*a* is pivotally connected to a fixed connector at an upper end portion of supporting pole 1*a*, and a second end portion is connected to the tent cloth. A first end portion of support eave pole 22*a* is pivotally connected to sliding connector 23*a* which is slidably connected with supporting pole 1*a*. A second end portion of support eave pole 22*a* is pivotally connected to primary eave pole 21*a*. Eave structure 2*a* and an upper frame may be folded and unfolded together.

The above configured tent requires a stopper to be disposed to the eave structure, limiting the movement of the sliding connector. Further, the tent cloth is likely to sag and is easily depressed between the eave structures as a distance between adjacent eave structures is large. As such, the tent is unattractive and has a tendency to accumulate rain or snow on the tent cloth.

Thus, prior to the present disclosure there existed a need for eave structures and tent frames that address the above-mentioned issues.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Advantageously, the eave structures and tent frames having the same detailed in the present disclosure address the shortcomings in the prior art detailed above.

Various aspects of the present disclosure are directed to providing eave structures and tent frames having the same, which are configured to provide an increased shaded region and prevent sagging of a tent cloth.

An aspect of the present disclosure is directed to provide an eave structure of a tent frame, wherein the tent frame comprises a supporting pole, a fixed connector fixedly coupled with an upper end portion of the supporting pole and at least one sliding connector slidably coupled with the supporting pole and movable along the supporting pole below the fixed connector. The eave structure comprises a first primary eave pole and a second primary eave pole, wherein each primary eave pole has a first end portion configured to be pivotally connected with the fixed connector. The eave structure further comprises a first support eave pole corresponding to the first primary eave pole and a second support eave pole corresponding to the second primary eave pole, wherein each of the first and second support eave poles have a first end portion configured to be pivotally connected with the at least one sliding connector and a second end portion configured to be pivotally connected with the corresponding first or second primary eave pole. When the tent frame is unfolded, the first and second primary eave poles extend outwardly and upwardly with respect to the supporting pole, and form a first angle in-between.

In some embodiments, the fixed connector comprises a first connector, and the at least one sliding connector comprises a second connector. The first end portions of both the first and second support eave poles are configured to be pivotally connected with the second connector.

In some embodiments, the at least one sliding connector comprises a second connector and a third connector disposed below the second connector. The first end portion of the first support eave pole is configured to be pivotally connected with the second connector and the first end portion of the second support eave pole is configured to be pivotally connected with the third connector.

In some embodiments, the first angle is substantially 90°.

In some embodiments, the second end portion of each support eave pole is pivotally connected to an intermediate portion of a corresponding primary eave pole.

In some embodiments, an insertion hole is formed at the second end portion of each primary eave pole and a cross pole is removably inserted into the insertion holes of corresponding primary eave poles of adjacent supporting poles. In some embodiments, the cross pole comprises a first segment and a second segment pivotally connected to each other.

Another aspect of the present invention is directed to provide a tent frame comprising any of the above eave structure embodiments and further comprising a plurality of side pole units, each coupled with two adjacent supporting poles through one or more of the fixed and sliding connectors at the two adjacent supporting poles. An upper frame is coupled with the plurality of supporting poles by the plurality of fixed connectors and the plurality of sliding connectors, coupled with the plurality of side pole units, or coupled with both. Two or more eave structures, each coupled with a supporting pole in a subset of the plurality of supporting poles through one or more of the fixed and sliding connectors at the supporting pole, each comprise a first primary eave pole and a second primary eave pole, each having a first end portion pivotally connected with the fixed connector at the supporting pole, and a first support eave pole corresponding to the first primary eave pole and a second support eave pole corresponding to the second primary eave pole. Each of the first and second support eave poles have a first end portion pivotally connected with the at least one sliding connector and a second end portion pivotally connected with the corresponding first or second primary eave pole. When the tent frame is unfolded, the first and second primary eave poles extend outwardly and upwardly with respect to the supporting pole and extend outwardly beyond the upper frame.

In some embodiments, the upper frame comprises a hub and a plurality of upper pole units, and each upper pole unit is disposed between the hub and a supporting pole in the plurality of supporting poles. The plurality of upper pole units comprise a plurality of upper poles pivotally connected with each other, and further comprises a first upper pole adjacent the hub and a second upper pole adjacent the supporting pole. The first upper pole has an end portion pivotally connected with the hub, and the second upper pole has an end portion pivotally connected with the fixed connector at the supporting pole. Additionally, an oblique pole has a first end portion pivotally connected with the second upper pole and a second end portion pivotally connected with the at least one sliding connector at the supporting pole.

In some embodiments, each side pole unit in the plurality of side pole units comprises one or more side pole pairs connected with each other. Each side pole pair comprises first and second side poles crossly and pivotally connected with each other, and each of the first and second side poles adjacent a supporting pole has an end portion pivotally connected with the fixed or sliding connector at the supporting pole.

In some embodiments, the upper frame comprises a central pole, a fixed hub fixedly coupled with the central pole at a lower end thereof, a sliding hub slidably coupled with the central pole and movable along the central pole above the fixed hub, and a plurality of upper pole units. Each upper pole unit is disposed between the central pole and a side pole unit in the plurality of side pole units, wherein each upper pole unit comprises one or more upper pole pairs connected with each other, and each upper pole pair comprises first and second upper poles crossly and pivotally connected with each other. Each of the first and second upper poles adjacent the central pole has an end portion pivotally connected with the fixed or sliding hub at the central pole, and each of the first and second upper poles adjacent the side pole unit has an end portion pivotally connected with the first or second side pole of a corresponding side pole pair of the side pole unit.

In some embodiments, each side pole unit in the plurality of side pole units comprises two side pole pairs, and each upper pole unit in the plurality of upper pole units comprises one upper pole pair.

In some embodiments, a number of supporting poles and a number of eave structures are the same, wherein each respective supporting pole in the plurality of supporting poles has a corresponding eave structure.

In some embodiments, the plurality of side pole units each comprises a plurality of side poles pivotally connected to each other.

In some embodiments, corresponding to each supporting pole in the subset of the plurality of supporting poles, the fixed connector comprises a first connector, the at least one sliding connector comprises a second connector, and the first end portions of both the first and second support eave poles are pivotally connected with the second connector.

In some embodiments, corresponding to each supporting pole in the subset of the plurality of supporting poles, the fixed connector comprises a first connector, the at least one sliding connector comprises a second connector and a third connector disposed below the second connector, the first end portion of the first support eave pole is pivotally connected with the second connector, and the first end portion of the second support eave pole is pivotally connected with the third connector.

In some embodiments, corresponding to each supporting pole in the subset of the plurality of supporting poles, the second end portion of each support eave pole is pivotally connected to an intermediate portion of a corresponding primary eave pole.

The eave structures and tent frames of the present invention have other features and advantages that will be apparent from, or are set forth in more detail in the accompanying drawings, which are incorporated herein, and the following Detailed Description, which together serve to explain certain principles of the exemplary embodiments of the present invention.

Figure 1:
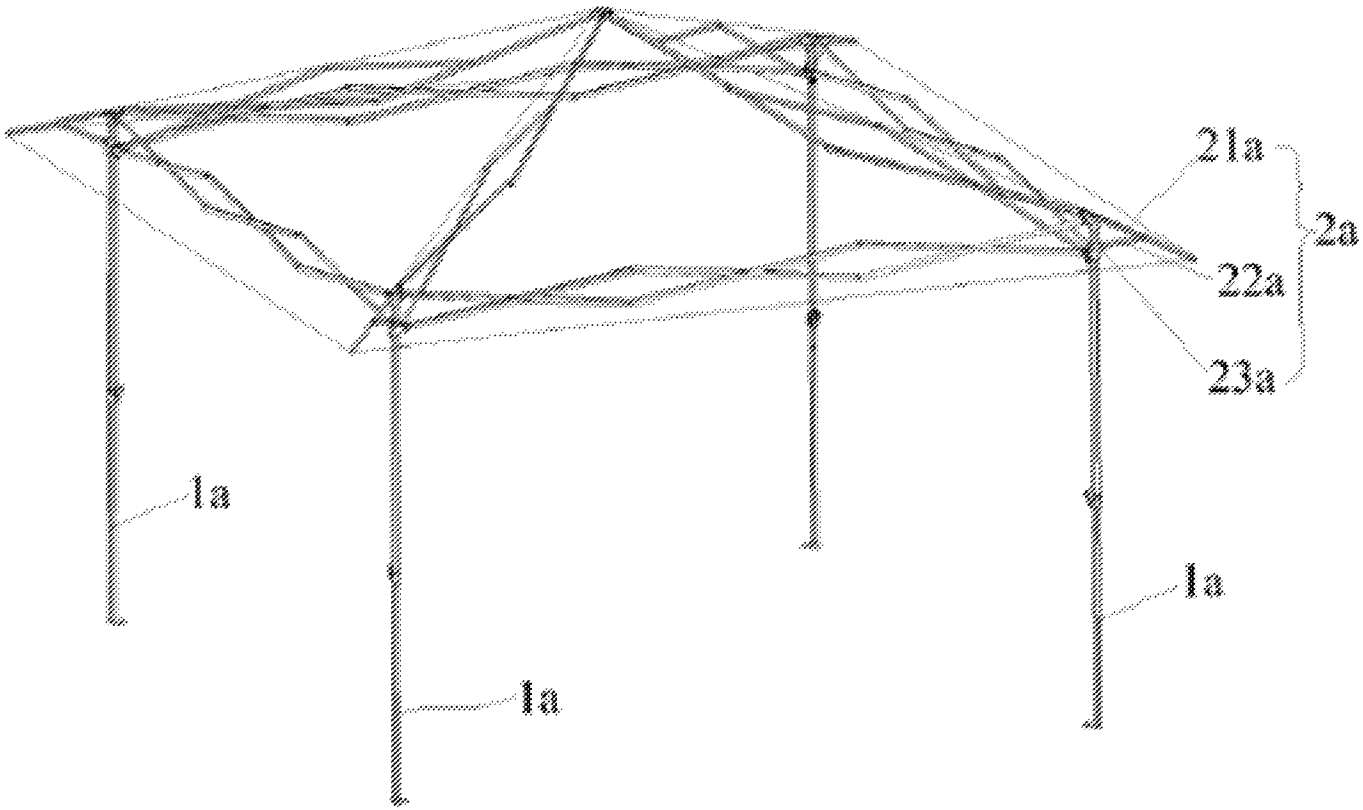
(PRIOR ART) FIG. 1
FIG. 1 is a schematic view illustrating a tent according to the prior art.
Figure 2:
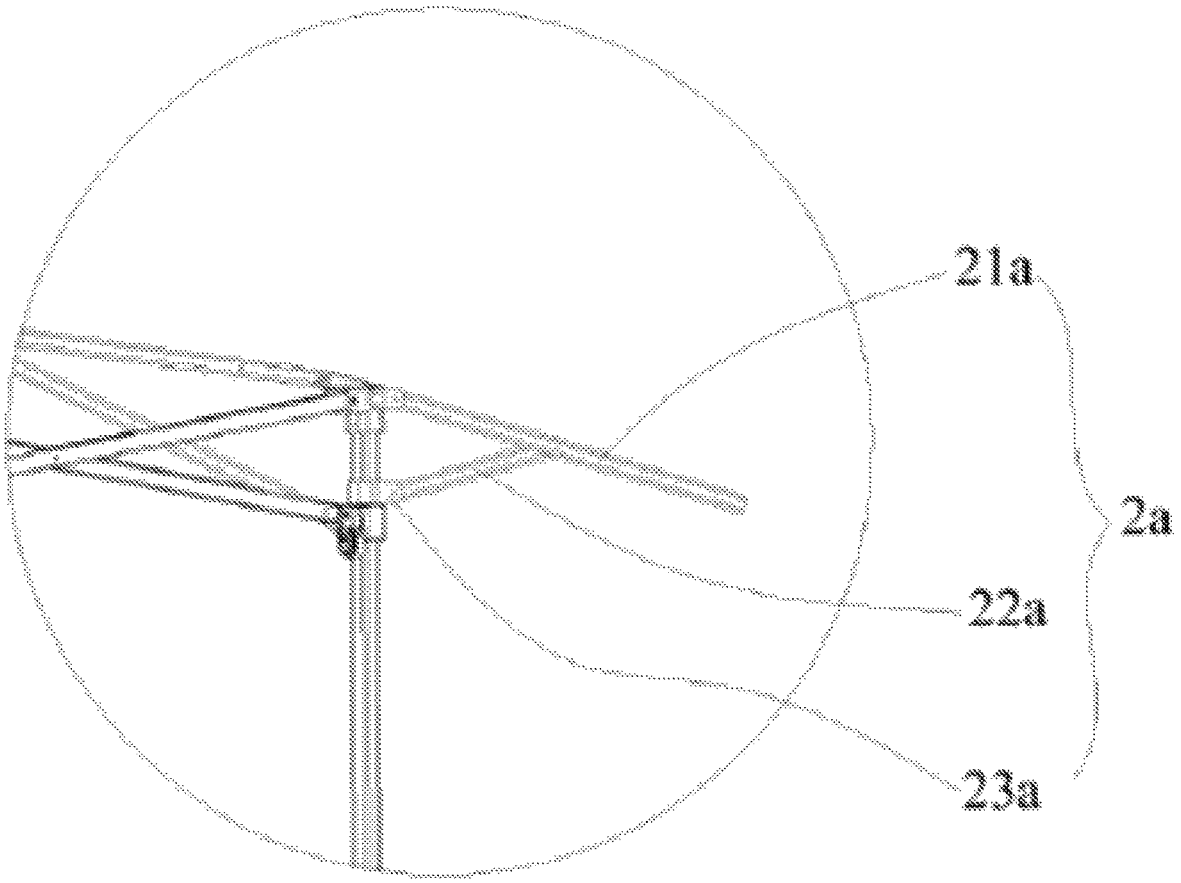
(PRIOR ART) FIG. 2
FIG. 2 is a schematic view illustrating an eave structure of FIG. 1.
Figure 3:
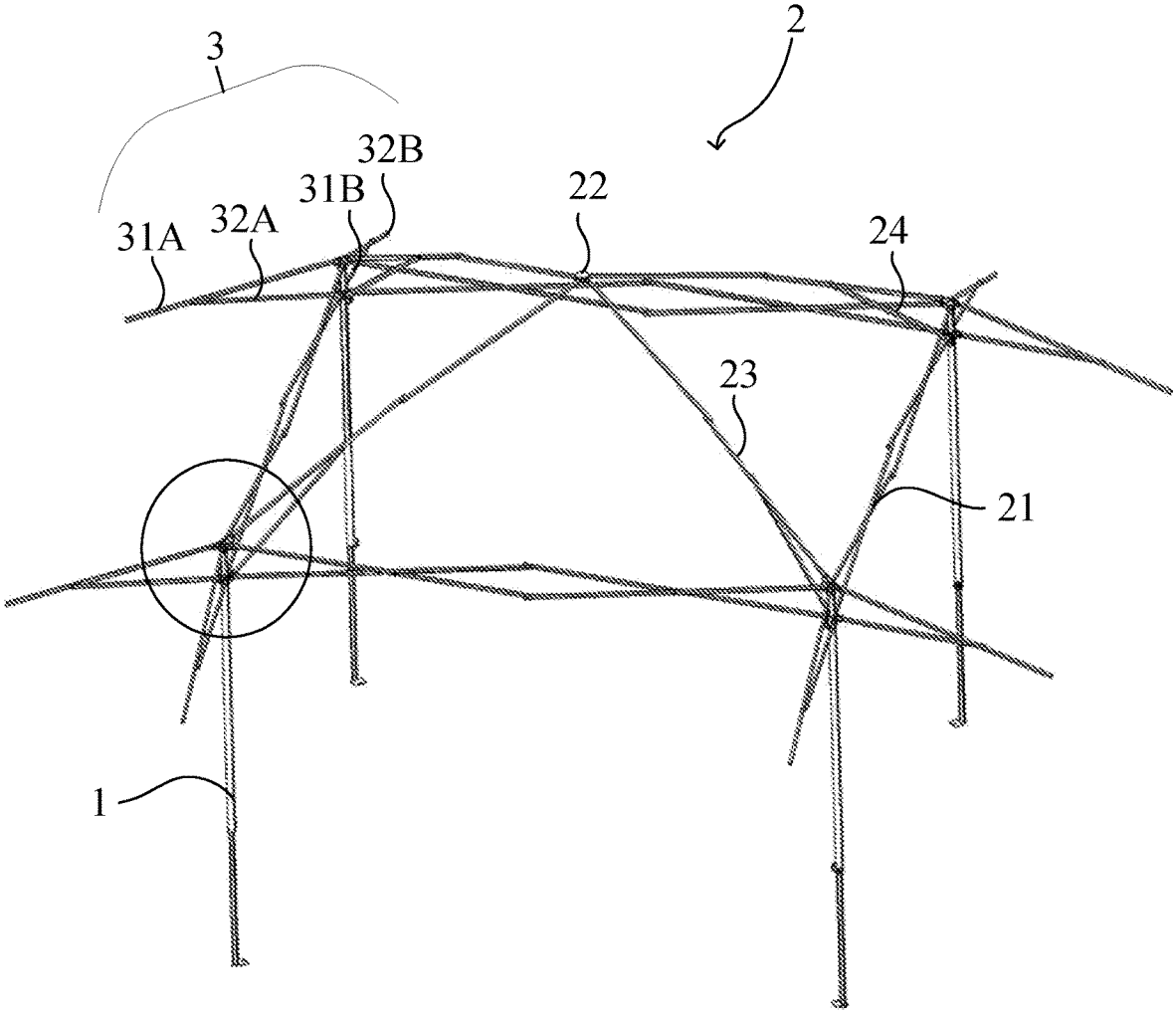
FIG. 3 is a schematic view illustrating a tent frame in an unfolded state according to an exemplary embodiment of the present invention.
Figure 4:
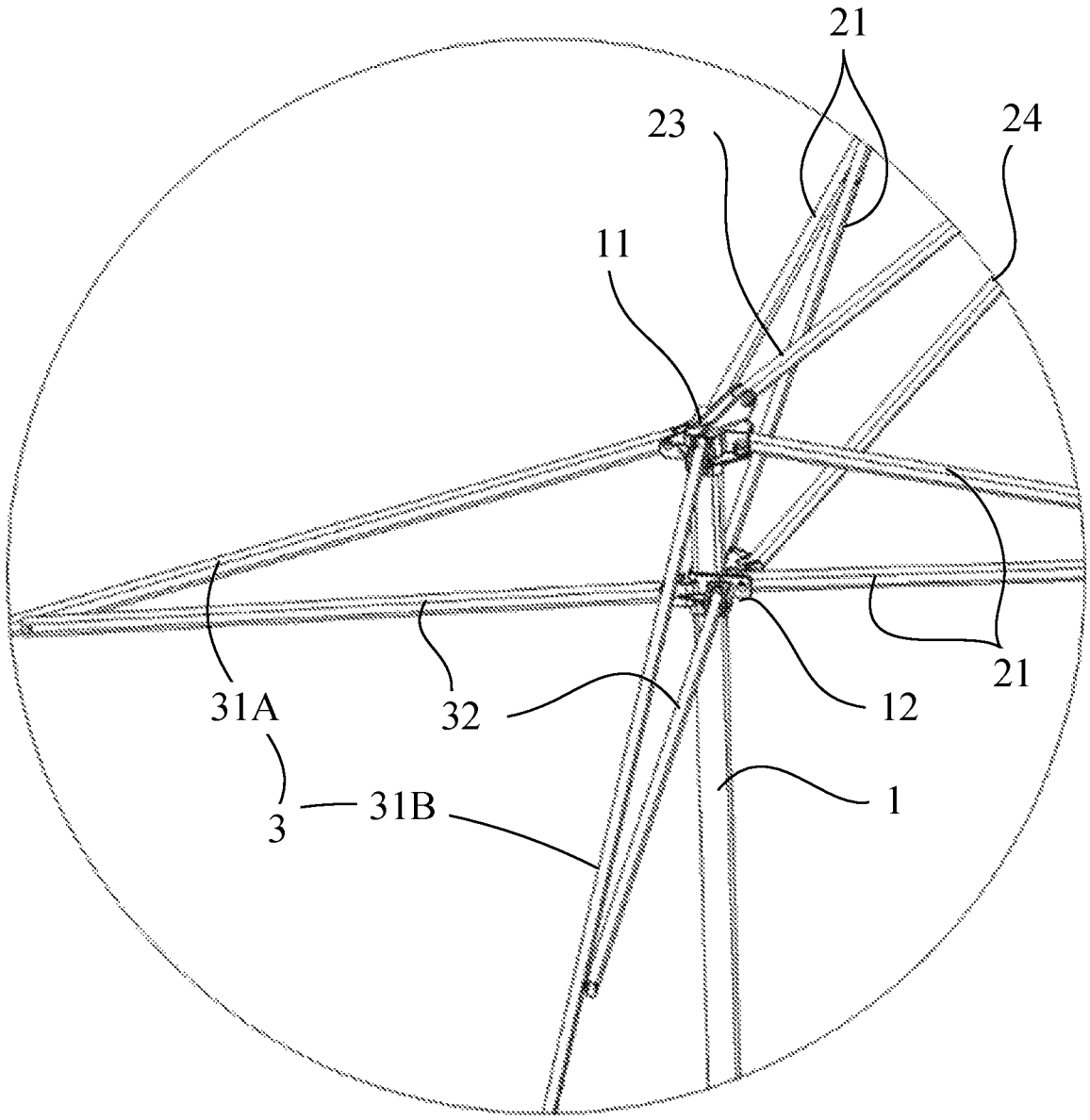
FIG. 4 is an enlarged view taken along the circle in FIG. 3.
Figure 5:
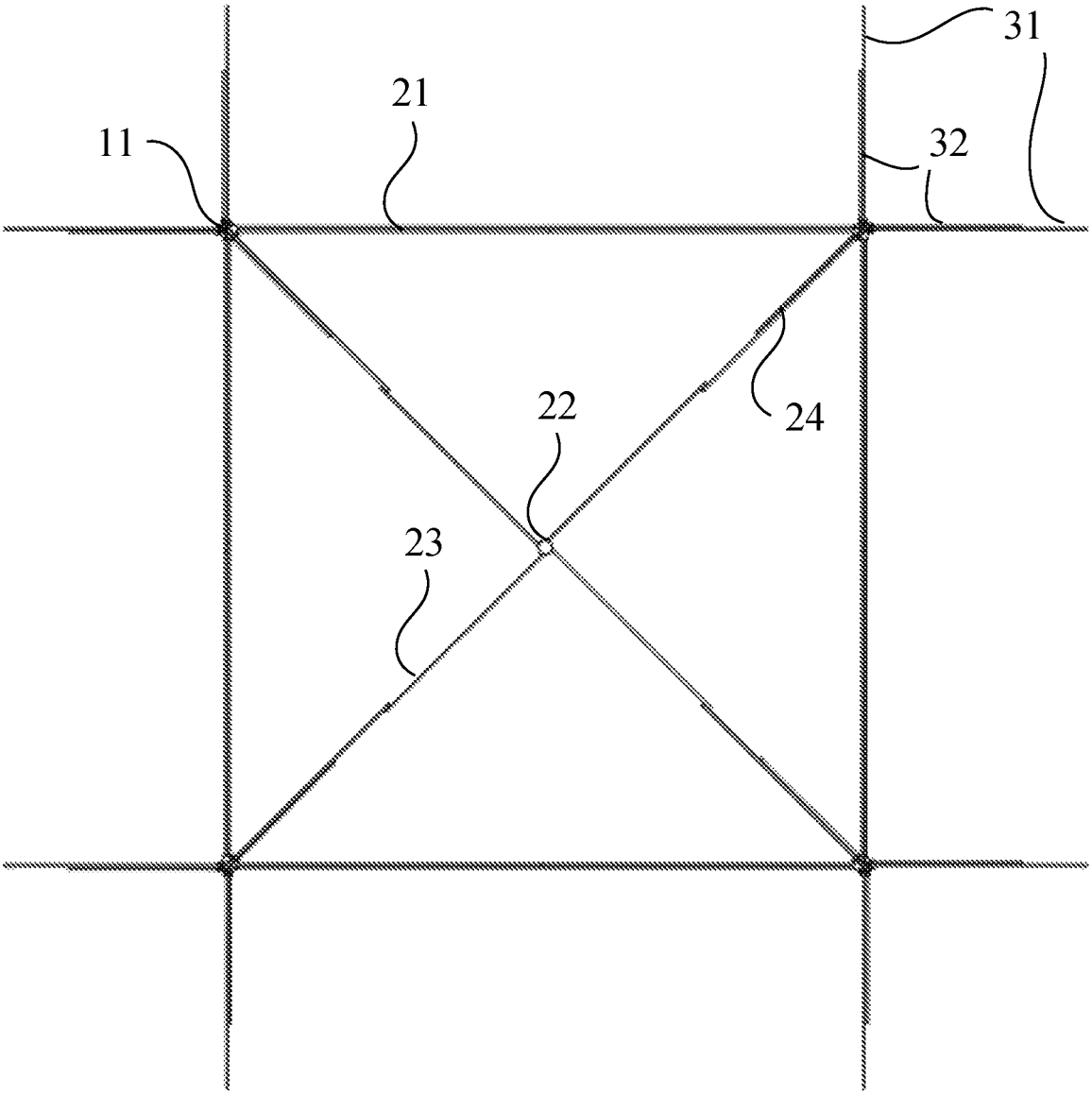
FIG. 5 is a schematic top view illustrating the tent frame of FIG. 3.

It should be understood that the appended drawings are not necessarily to scale, and are intended for illustration of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

It will also be understood that, although the terms first, second, etc. may be used herein to describe various elements, these elements should not be limited by these terms. These terms are only used to distinguish one element from another. For example, a first subject could be termed a second subject, and, similarly, a second subject could be termed a first subject, without departing from the scope of the present disclosure. The first subject and the second subject are both subjects, but they are not the same subject. Furthermore, the terms "subject" and "user" are used interchangeably herein.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Various aspects of the present disclosure are directed to providing eave structures and tent frames having such eave structures. Generally, a tent frame of the present invention includes a plurality of supporting poles, a plurality of side pole units, and an upper frame connected to the plurality of supporting poles or the plurality of side pole units or both. The tent frame can be a plurality of sizes and shapes, and can include any number of supporting poles including three, four, five, or more supporting poles. The tent frame of the present invention also includes a plurality of eave structures, a number of which may be varied depending on a designer's preference. For instance, the tent frame may include two eave structures, three eave structures, or a number corresponding to the number of supporting poles.

An eave structure typically comprises a first primary eave pole and a second primary eave pole pivotally connected with a fixed connector at a supporting pole. The eave structure also comprises a first support eave pole and a second support eave pole connected with one or more sliding connectors at the supporting pole and with the corresponding first and second primary eave poles. When the tent frame is unfolded, the eave poles extend beyond the upper frame and/or supporting pole. Such an eave structure, along with the upper frame, can be used to support a tent cloth including a canopy. As the eave poles extend beyond the tent frame, the shaded region increases and further protects occupants from rain or snow.

In some embodiments, the first and second support eave poles are connected with one sliding connector at the supporting pole. In some embodiments, the first and second support eave poles are connected to two different sliding connectors at the supporting pole.

Referring to FIG. 3 to FIG. 8, there is depicted a tent frame according to an exemplary embodiment of the present invention. As shown, the tent frame includes a plurality of supporting poles 1 with a plurality of fixed connectors 11 and a plurality of second connectors 12 disposed on the supporting poles and configured to connect the supporting poles to various elements of the tent frame. In some embodiments, each fixed connector is fixedly coupled with a supporting pole at an upper end portion (e.g. the top) of the supporting pole. Each second connector is slidably coupled with a supporting pole and movable along the supporting pole below the first connector. Further, a plurality of side pole units 21 each couple two adjacent supporting poles though one or more of the fixed and second connectors of the two adjacent supporting poles.

The tent frame also includes an upper frame, such as upper frame 2, coupled with the plurality of supporting poles. Upper frame 2 is disposed above and supported by the plurality of supporting poles when the tent frame is unfolded. In some embodiments, upper frame 2 includes hub 22, and a plurality of upper pole units. In the illustrated embodiment, each upper pole unit comprises upper pole 23 and oblique pole 24. In some embodiments, each upper pole 23 comprises a first upper pole and a second upper pole directly or indirectly coupled with each other. Each of the first upper pole, second upper pole, and oblique pole has a first end portion and a second end portion. The first end portion of each first upper pole 23 is pivotally connected to the hub. Each second upper pole 23 is pivotally connected with the corresponding first upper pole, directly or indirectly. The second end portion of each second upper pole 23 is pivotally connected with the corresponding fixed connector. The first end portion of each oblique pole 24 is pivotally connected with the corresponding second upper pole. The second end portion of each oblique pole 24 is pivotally connected with the corresponding second connector. Further, each side pole unit 21 is coupled with two adjacent supporting poles 1 by fixed connector 11 and second connector 12 at the two adjacent supporting poles.

In some embodiments, each side pole unit in the plurality of side pole units comprises one or more side pole pairs connected with each other, wherein each side pole pair comprises first and second side poles crossly and pivotally connected with each other, and each of the first and second side poles adjacent a supporting pole has an end portion pivotally connected with the fixed or second connector at the supporting pole.

In some embodiments, the upper frame comprises alternative, additional, or optional components. For instance, referring to FIG. 9, in some embodiments, upper frame 2 comprises hub 22, sliding hub 27, central pole 25, and a plurality of upper pole units. Hub 22 is fixedly coupled with the central pole at a lower end of the central pole, and in some cases, is termed as a fixed hub. Sliding hub 27 is slidably coupled with the central pole and movable along the central pole above the hub. Each upper pole unit is disposed between the central pole and a side pole unit in a plurality of side pole units. It should be noted that the term "central pole" as used herein can be, but does not necessarily have to be, at a center of the tent frame.

Figure 9:
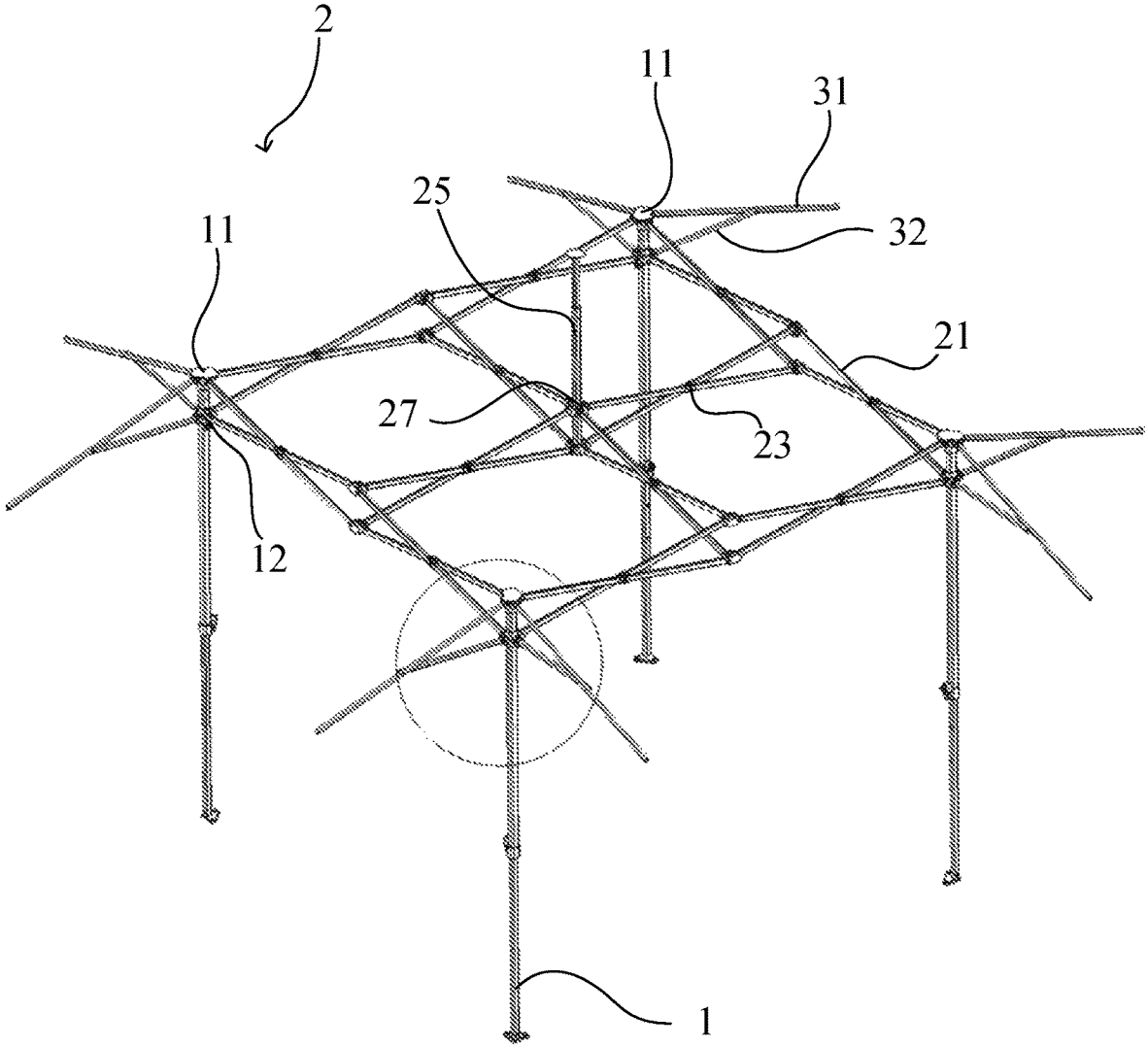
FIG. 9 is a schematic view illustrating a tent frame in an unfolded state according to another exemplary embodiment of the present invention.
Figure 10:
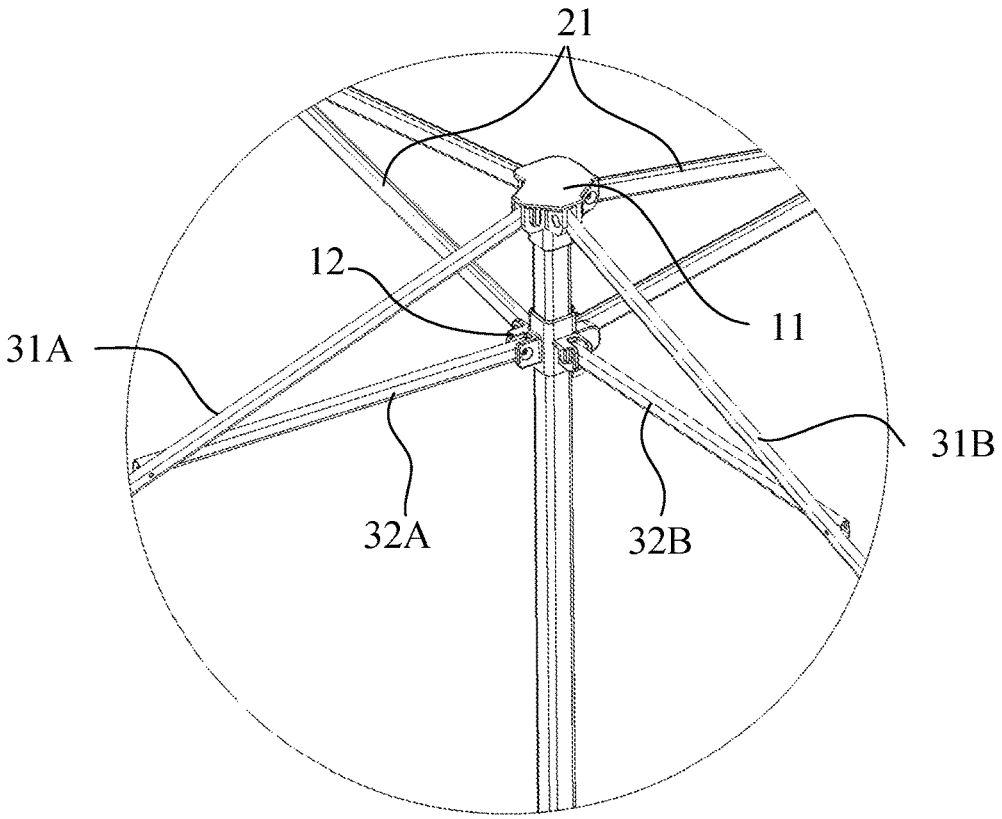
FIG. 10 is an enlarged view taken along the circle in FIG. 9.
Figure 11:
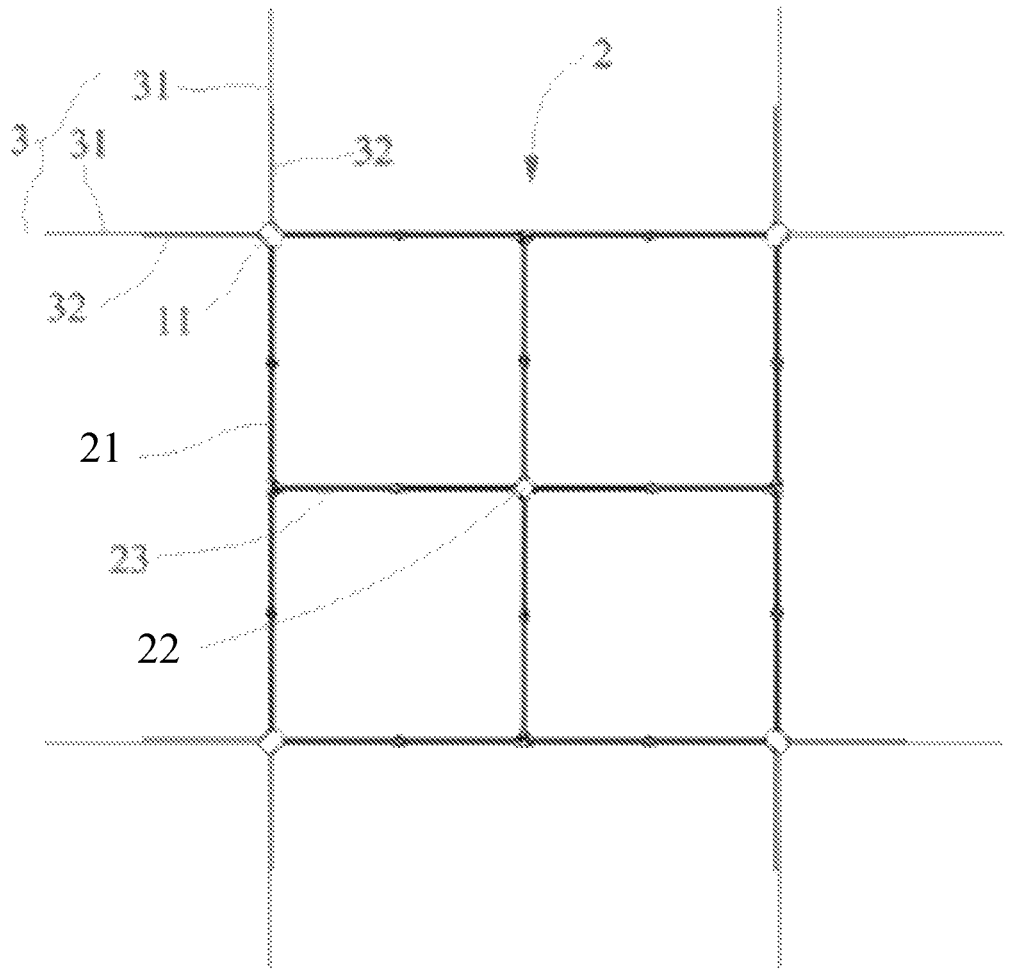
FIG. 11 is a schematic top view illustrating the tent frame of FIG. 9.
Figure 12:
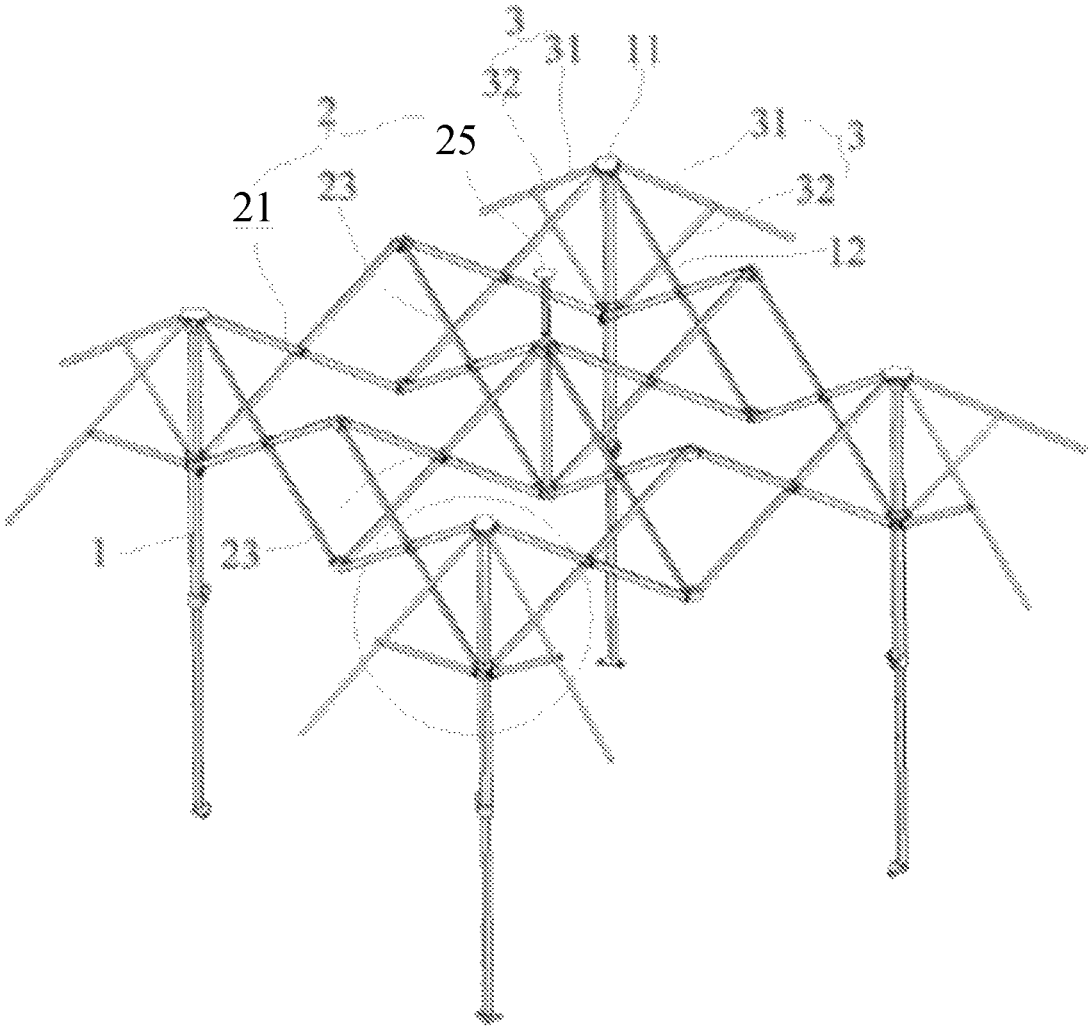
FIG. 12 is a schematic view illustrating the tent frame of FIG. 9 in a semi-folded state.
Figure 13:
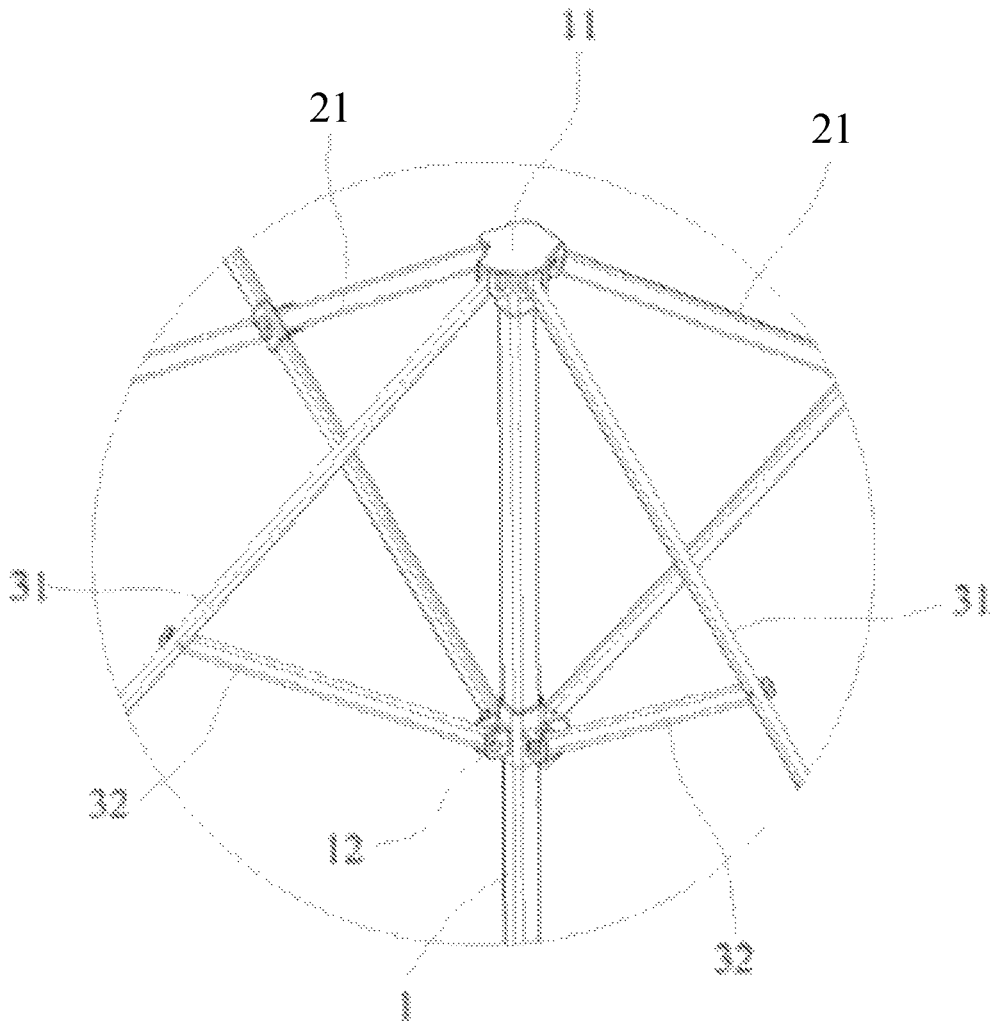
FIG. 13 is an enlarged view taken along the circle in FIG. 12.

In some embodiments, each upper pole unit comprises one or more upper pole pairs connected with each other. Each upper pole pair comprises first and second upper poles crossly and pivotally connected with each other. Each of the first and second upper poles adjacent the central pole has an end portion pivotally connected with the fixed or sliding hub at the central pole. Further, each of the first and second upper poles adjacent the side pole unit has an end portion pivotally connected with the first or second side pole of a corresponding side pole pair of the side pole unit. By way of example, FIG. 9 illustrates each upper pole unit comprising one pair of upper poles 23, disposed between central pole 25 and corresponding side pole 21, in a pivotable crossing, scissor, or X fashion.

The tent frame further includes two or more eave structures 3, and connectors to couple the eave poles with the upper frame and the supporting poles, or various elements disposed on the supporting poles. In some embodiments, an eave structure includes a plurality of eave poles. In some embodiments, an eave structure includes a plurality of eave poles and a mechanism (e.g., a connector or a link) coupling the eave poles with the upper frame and/or a supporting pole.

In various embodiments, each eave structure comprises a first primary eave pole, a second primary eave pole, and corresponding first and second support eave poles. The primary eave poles have first end portions pivotally coupled to a fixed connector, and the support eave poles have first end portions pivotally coupled with one or more sliding connectors. The second end portion of each primary eave pole and the corresponding support eave pole are coupled to each other. When the tent frame is unfolded, the primary eave poles extend outwardly and upwardly with respect to the supporting pole, and form a first angle in-between. In an exemplary embodiment of the present invention, the first angle is approximately 90°.

Referring to FIG. 3 to FIG. 14, in some embodiments, each eave structure 3 comprises first primary eave pole 31A, second primary eave pole 31B, first support eave pole 32A, and second support eave pole 32B. The first end portions of primary eave poles 31 are pivotally coupled to fixed connector 11, and the second end portions of primary eave poles 31 are pivotally coupled to the second end portions of corresponding support eave poles 32. First end portions of support eave poles 32 are pivotally coupled to sliding connector 12, which is configured to slidably move along supporting pole 1. In some embodiments, the second end portion of each support eave pole is pivotally coupled to an intermediate portion of the corresponding primary eave pole.

Referring to FIG. 15 to FIG. 22, in some embodiments, each eave structure 3 comprises first primary eave pole 31A, second primary eave pole 31B, first support eave pole 32A, and second support eave pole 32B. The first end portions of primary eave poles 31A and 31B are pivotally coupled to fixed connector 11, and the second end portions of primary eave poles 31A and 31B are pivotally coupled to the corresponding second end portions of support eave poles 32A and 32B. The first end portion of first support eave pole 32A is pivotally coupled to second connector 12, and the first end portion of second support eave pole 32B is pivotally connected to third connector 13.

As described above, since second connectors 12 are mutually connected through side pole units 21, the eave poles coupled thereto form linked eave structures 3A comprising first eave poles. Unlinked, or separate, eave structures 3B, comprising second eave poles, are thus formed through standalone third connectors 13.

In the present case, the plurality of first primary eave poles and the plurality of first support eave poles are linked to each other through the mutual connection of the second connectors and the side pole units. The linkage folds and unfolds as a whole. On the other hand, the plurality of second primary eave poles and the plurality of second support eave poles are unlinked and can be individually deployed or unfolded as there are no mutual connections.

In some embodiments, the tent frame further comprises a cross pole interposing eave poles of adjacent supporting poles. The cross pole is coupled, for instance, by inserting an end of the cross pole into an insertion hole formed at the second end portion of each primary eave pole. In some embodiments, the cross pole comprises a plurality of segments such as a first segment and a second segment pivotally connected to each other.

Figure 17:
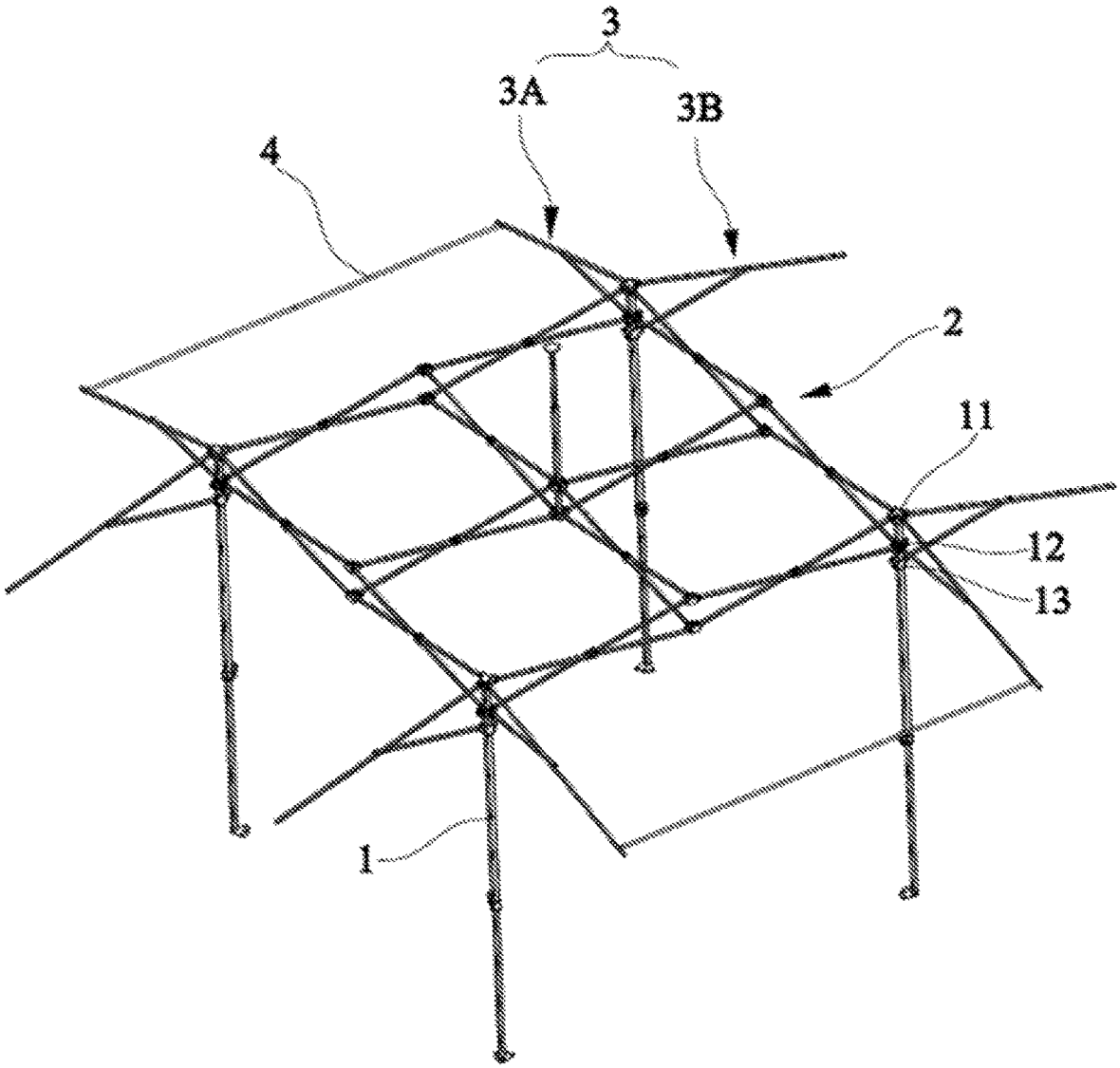
FIG. 17 is a schematic view illustrating the tent frame of FIG. 15 with some additional or optional elements.
Figure 18:
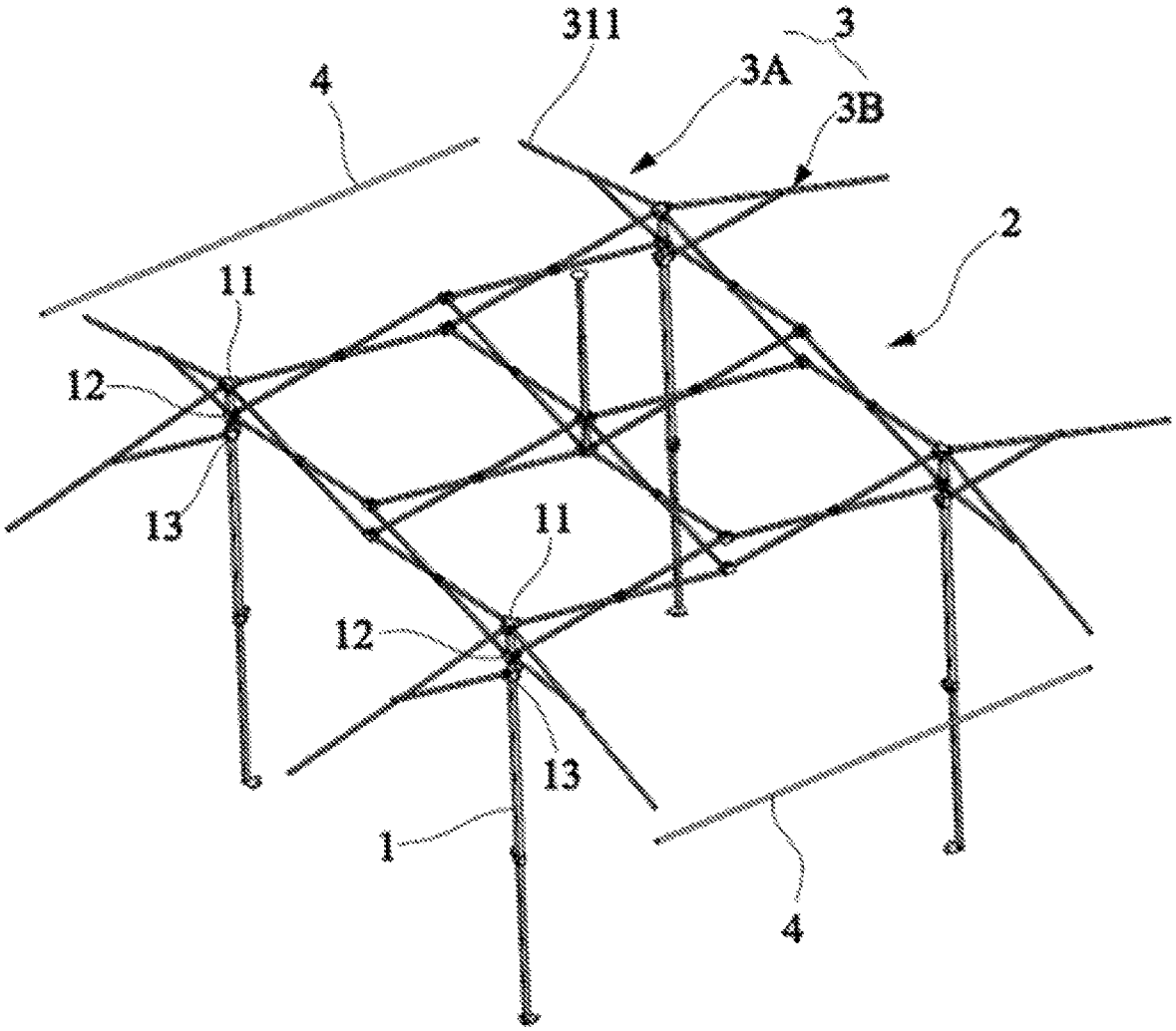
FIG. 18 is a schematic view illustrating a partially assembled tent frame of FIG. 17.
Figure 19:
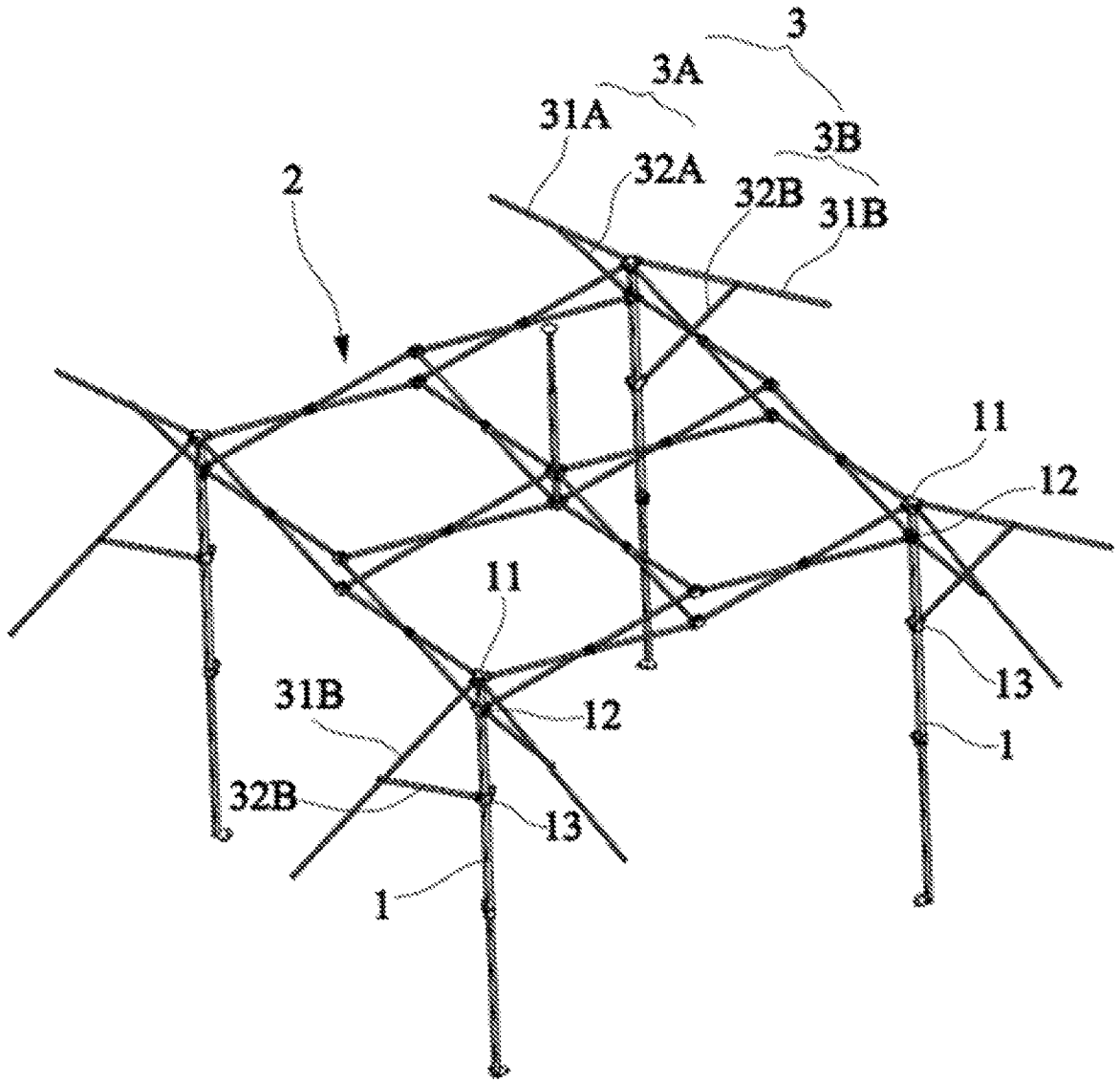
FIG. 19 is a schematic view illustrating the tent frame of FIG. 15 in a first semi-folded state.
Figure 20:
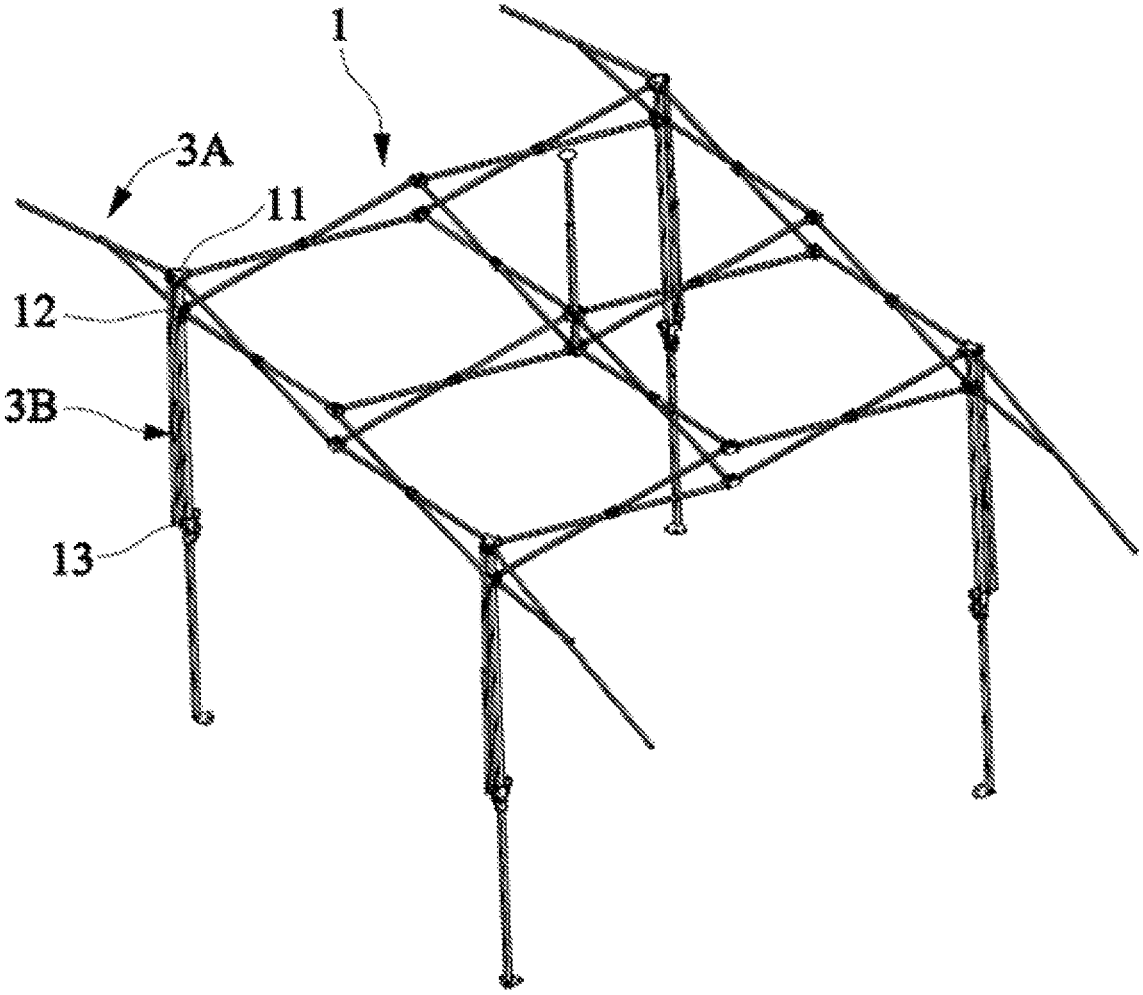
FIG. 20 is a schematic view illustrating the tent frame of FIG. 15 in a second unfolded state.
Figure 21:
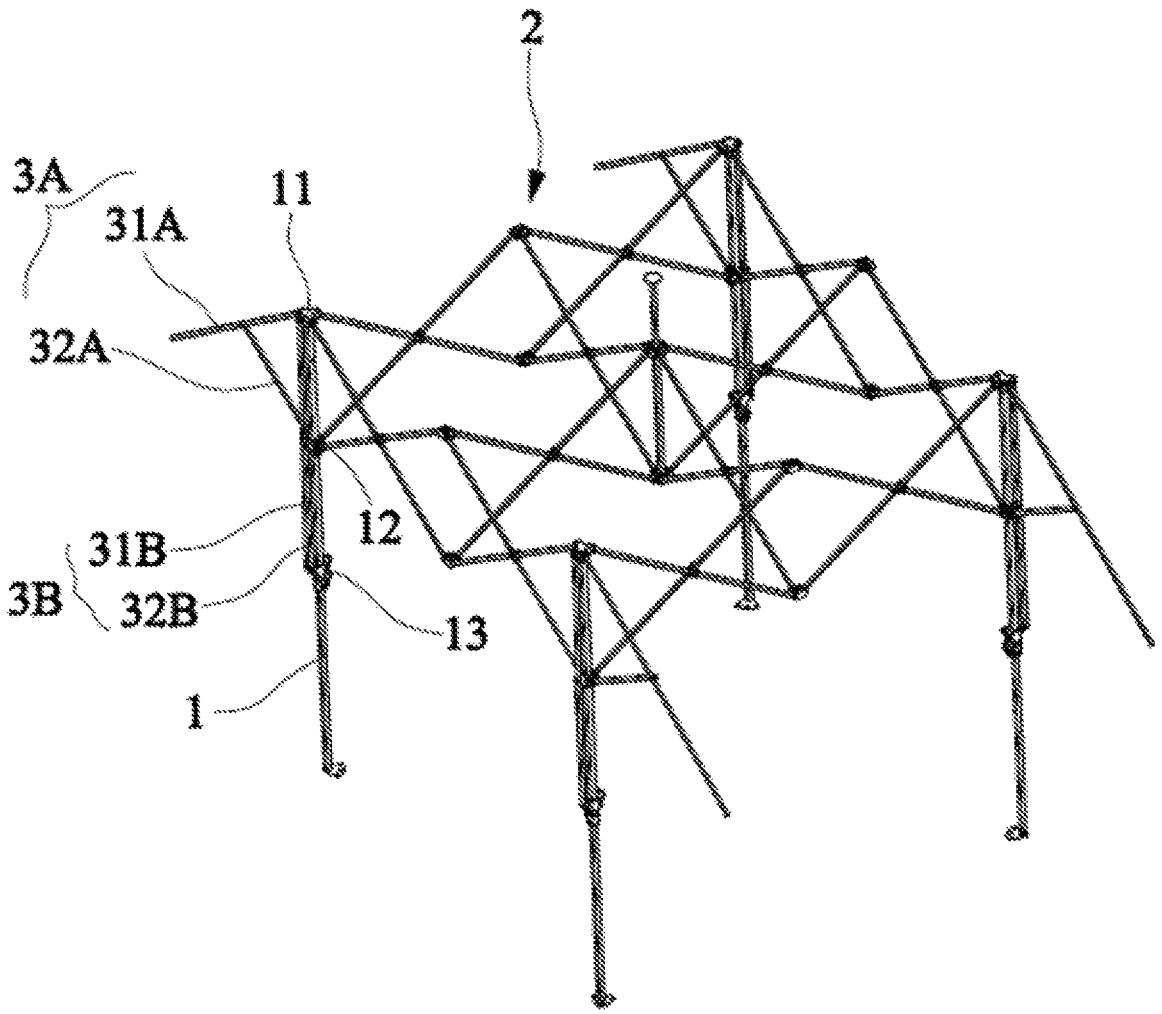
FIG. 21 is a schematic view illustrating the tent frame of FIG. 15 in a second semi-folded state.

Referring to FIG. 17 and FIG. 18, in some embodiments, insertion hole 311 is formed at the second end portion of each primary eave pole 31, and cross pole 4 is removably inserted into the insertion holes of corresponding primary eave poles 31 of adjacent supporting poles 1. Cross pole 4 is configured to further extend a tent cloth and prevent sagging thereon.

It should be noted that a tent frame of the present invention can include a various number of eave structures, depending on the designer's preference. It should also be noted that tent frame of the present invention can include different types of eave structures in the same tent frame. For instance, in an embodiment where only one side of the tent needs shade, the tent frame can include two eave structures, with each eave structure connected with one of two adjacent supporting poles. In an embodiment where two sides of the tent need shade, the tent frame can include three eave structures, with each eave structure connected with one of three adjacent supporting poles. In a further embodiment where all sides of the tent need shade, the tent frame can include the same number of eave structures as the supporting poles, with each eave structure connected with one of the supporting poles.

The eave structure of the present invention can be folded and unfolded along with the other members of the tent frame, except the eave structure 3B illustrated in FIG. 15 to FIG. 22 which can be independently folded and unfolded at any time when desired. For instance, referring to FIG. 3, in some embodiments, when unfolding the tent frame, the plurality of supporting poles 1 are pulled outwardly (e.g., away from each other). First and second upper poles 23 are unfolded to form a substantially straight line. Second connector 12 slides upwardly along supporting pole 1, pushing the eave poles 31 and 32 outwardly beyond the upper frame and/or supporting poles, extending side poles 21 laterally. In some embodiments, such as that illustrated in FIG. 20, second connector 12 only deploys eave poles 3A, and third connector 13 must slide upwardly along supporting pole 1 to push eave poles 3B outwardly beyond the upper frame and/or supporting poles.

Figure 6:
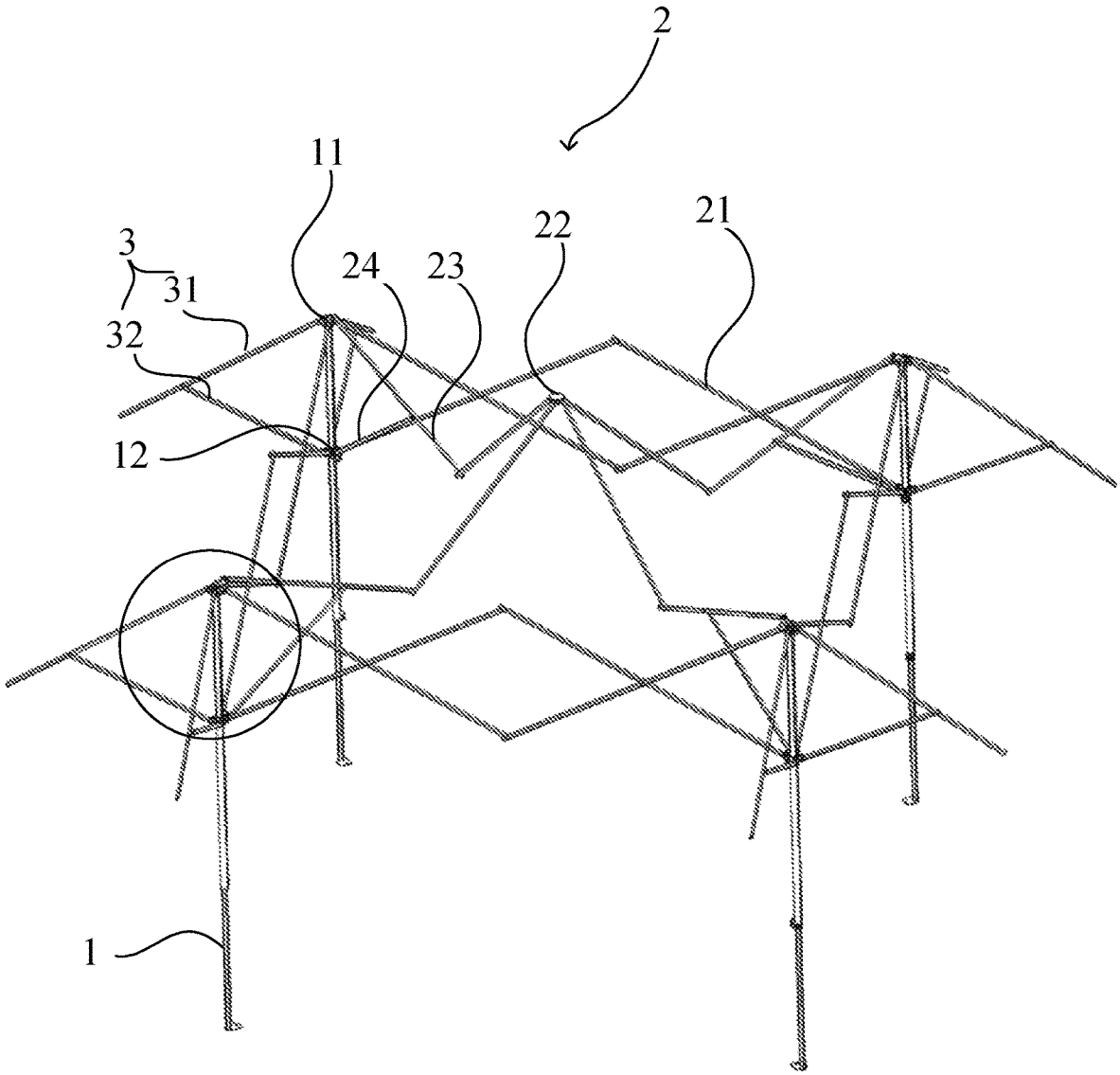
FIG. 6 is a schematic view illustrating the tent frame of FIG. 3 in a semi-folded state.
Figure 7:
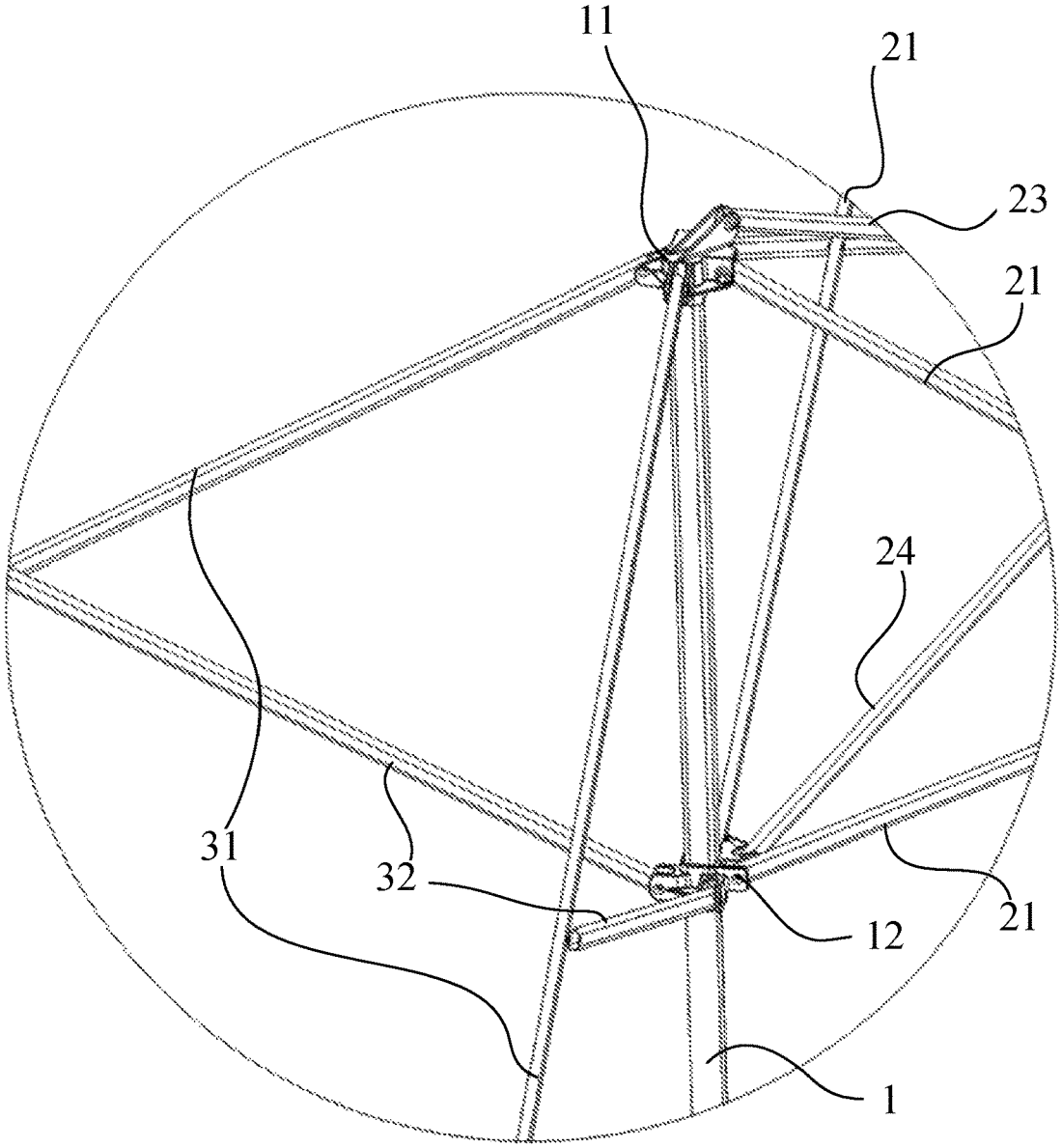
FIG. 7 is an enlarged view taken along the circle in FIG. 6.
Figure 8:
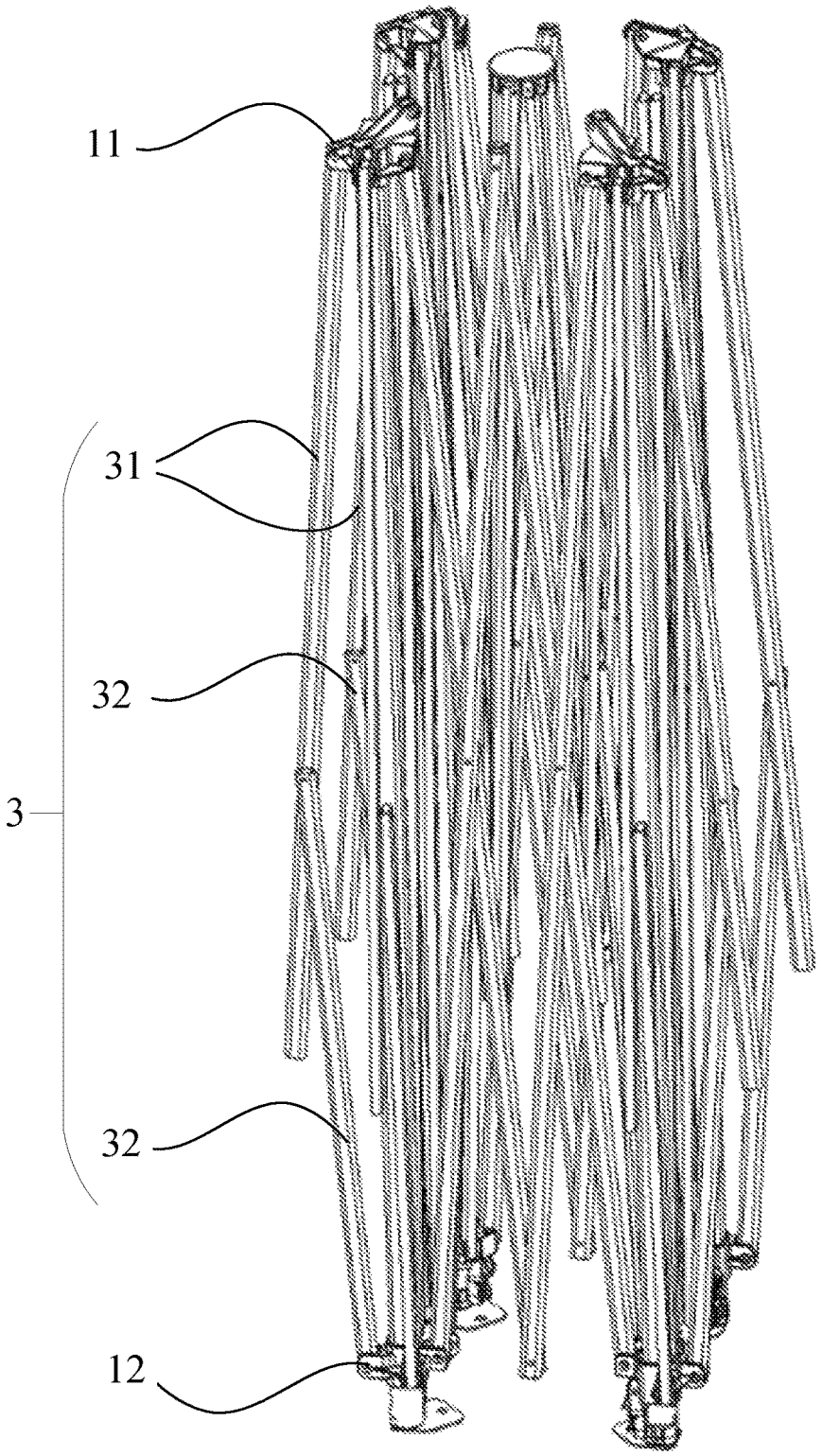
FIG. 8 is a schematic view illustrating the tent frame of FIG. 3 in a folded state.

Referring to FIG. 6, FIG. 7, and FIG. 8, when folding the tent frame, second connector 12 slides downwardly along supporting pole 1, pulling oblique pole 24 and side poles 21 downwardly. In turn, the oblique pole pulls downwardly upper poles 23, and accordingly primary and support eave poles 31 and 32 retract to be parallel to the supporting pole. Side pole units 21 constrict according to the downward motion of second connector 12.

Figure 14:
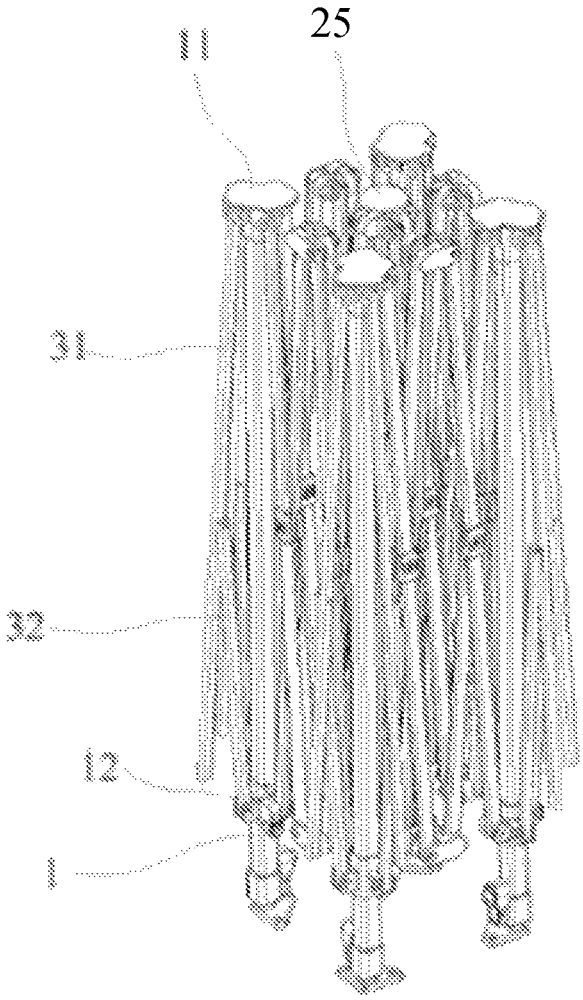
FIG. 14 is a schematic view illustrating the tent frame of FIG. 9 in a folded state.
Figure 15:
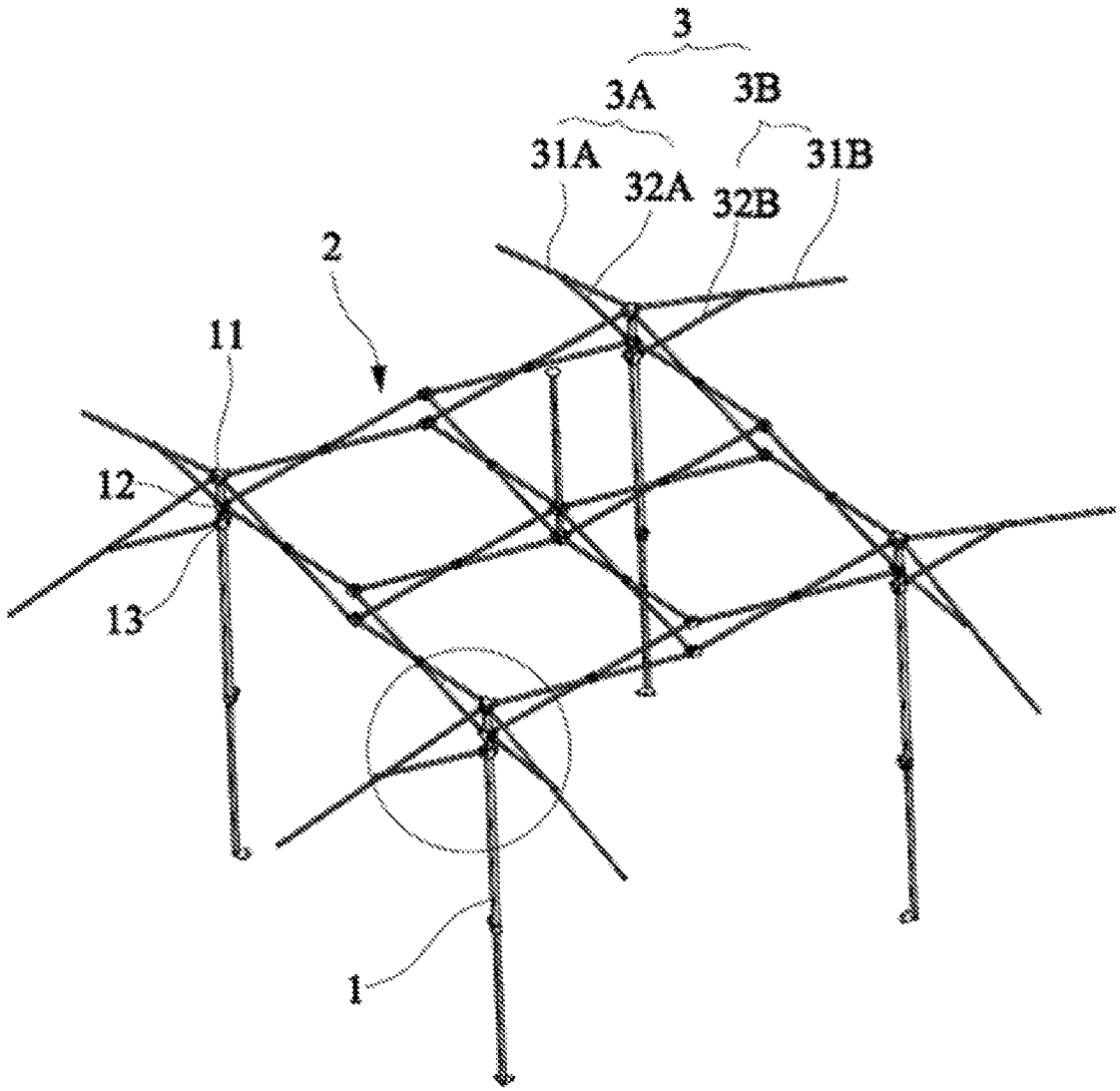
FIG. 15 is a schematic view illustrating a tent frame in a first unfolded state according to yet another exemplary embodiment of the present invention.
Figure 16:
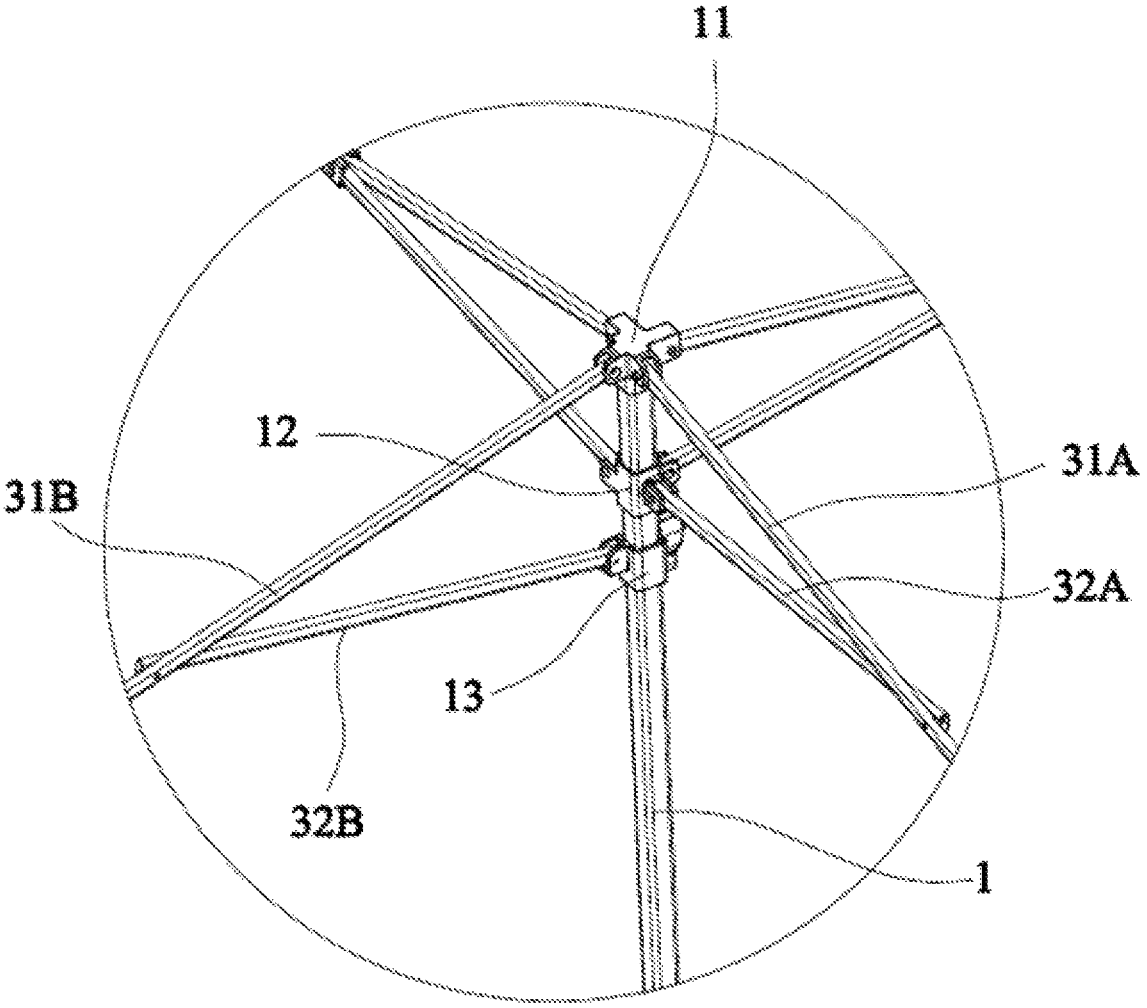
FIG. 16 is an enlarged view taken along the circle in FIG. 15.
Figure 22:
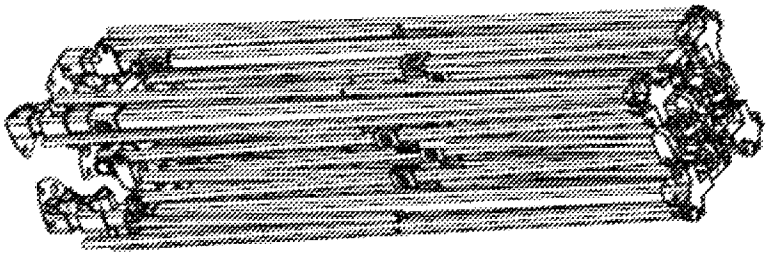
FIG. 22 is a schematic view illustrating the tent frame of FIG. 15 in a folded state.

Referring to FIG. 12 to FIG. 14 and FIG. 19 to FIG. 22, in some embodiments, when folding the tent frame, second connectors 12 and, when applicable third connectors 13, slide downwardly along supporting pole 1, wherein each of side poles 21, upper poles 23, and eave poles 31 and 32 retract to be parallel with the supporting poles. As illustrated in FIG. 8, FIG. 14, and FIG. 22, the folded tent frame, or tent, is compact with all poles folded towards each other.

Figure 23:
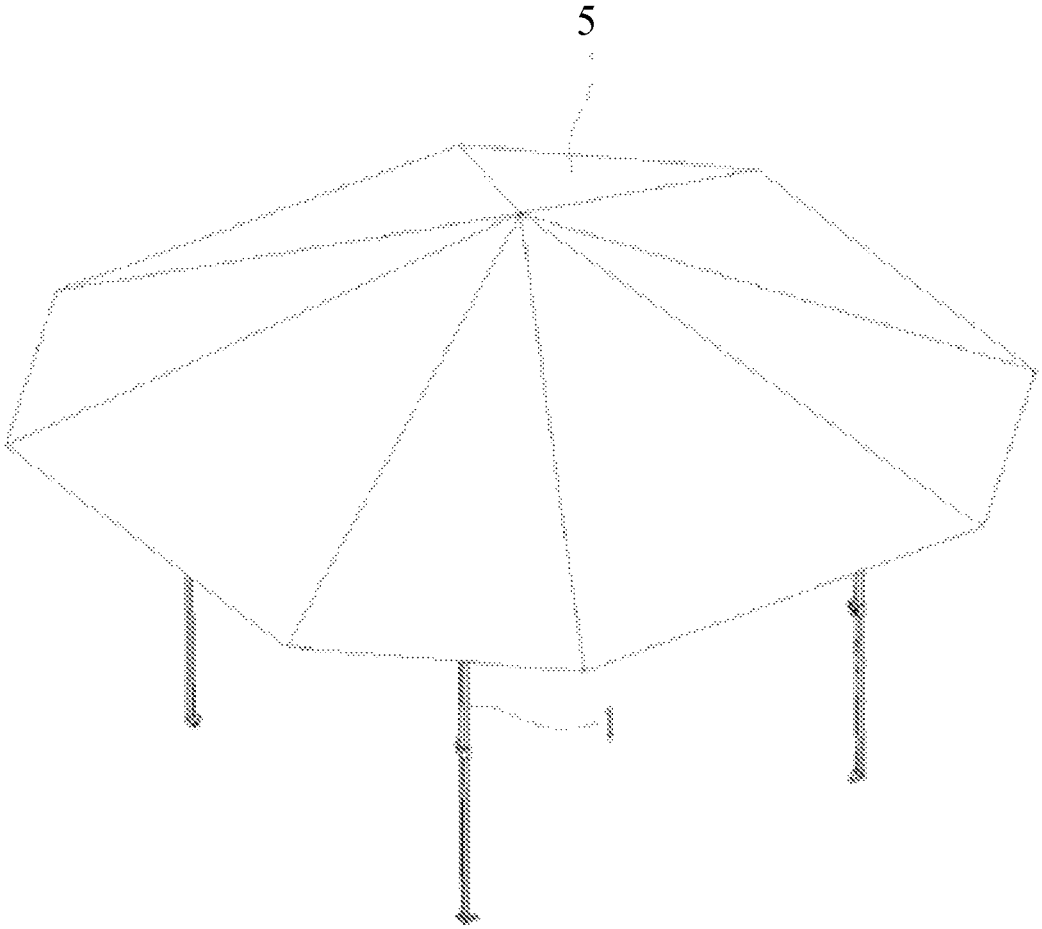
FIG. 23, FIG. 24, and FIG. 25 are schematic views illustrating tents in an unfolded state according to exemplary embodiments of the present invention.
Figure 24:
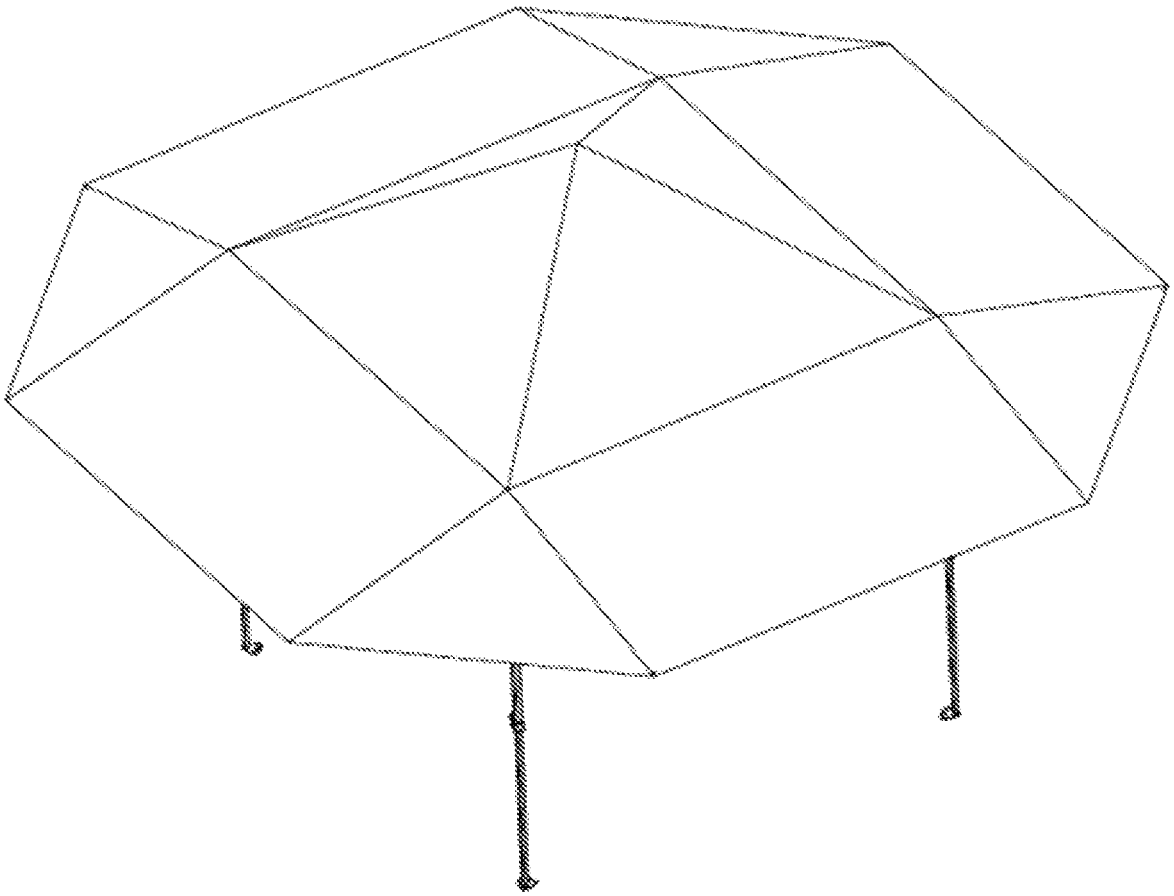
Figure 25:
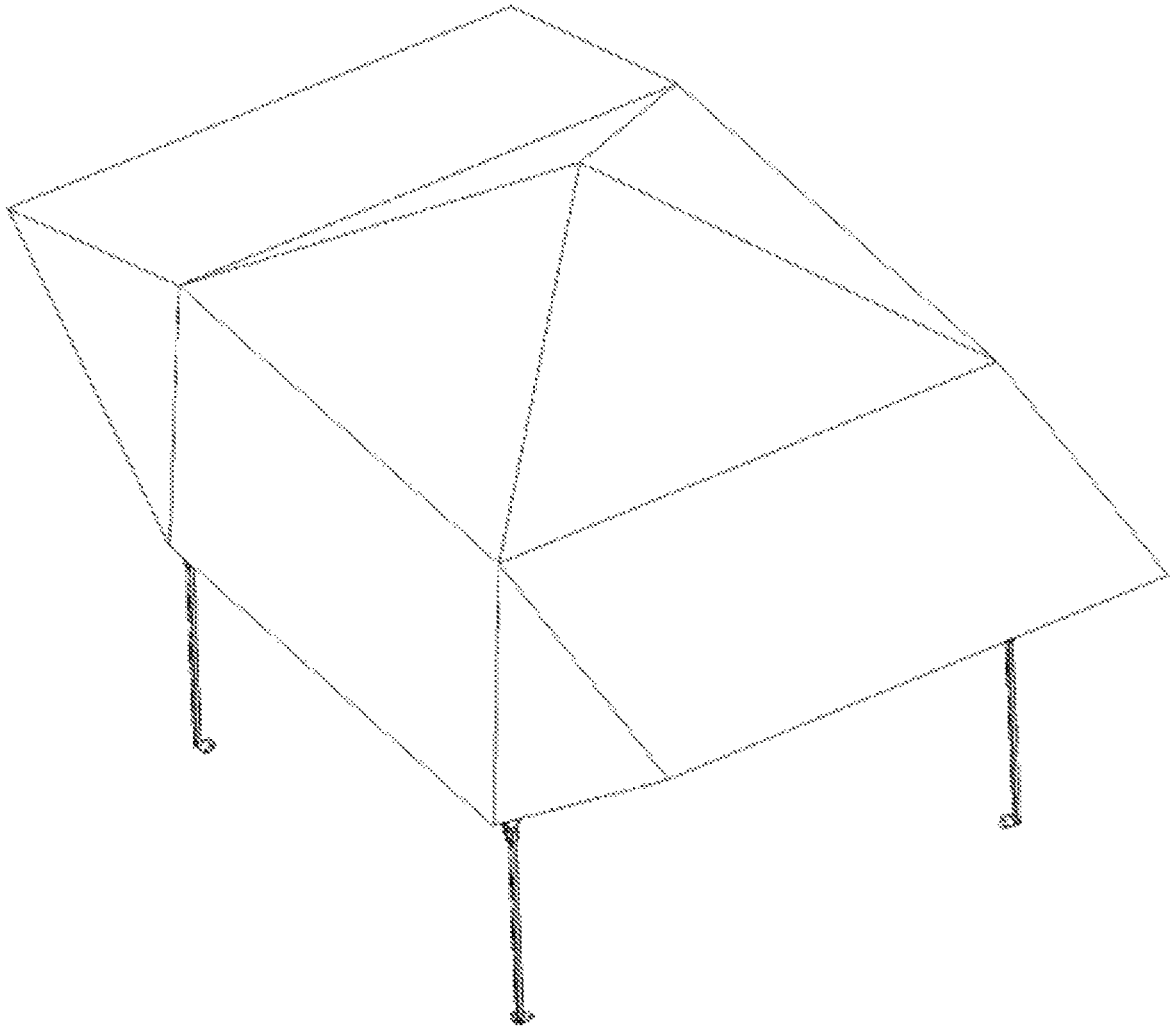

Referring to FIG. 23 to FIG. 25, the tent frame can be used to support cloth 5. As shown, depending on the number, location, and deployment of the eave structures the tent can assume a variety of shapes and structures according to the designer's or a user's preference.

As disclosed herein, when the tent frame is unfolded, the second end portion of eave poles 31 and 32 extend outwardly beyond the upper frame and the supporting pole. Further, a distance between adjacent eave poles is small, and thus sagging between eave poles can be prevented. Additionally, the eave structures of the present invention can be used to extend the tent cloth, including a canopy, beyond the sides of the tent. As a result, the eave structures help to provide a larger shaded region on sunny days. The eave structures of the present invention also help to smooth the tent canopy and prevent sagging, thus reducing a risk of accumulating water or snow. Further, when the tent frame of the present invention is folded, the structure is compact, thus increasing the mobility and storage capacity of the tent.

EXEMPLARY EMBODIMENTS

Provided in this section are non-limiting exemplary embodiments in accordance with the present disclosure.

Embodiment 1

An eave structure of a tent frame, wherein the tent frame comprises a supporting pole, a fixed connector fixedly coupled with an upper end portion of the supporting pole and at least one sliding connector slidably coupled with the supporting pole and movable along the supporting pole below the fixed connector, the eave structure comprising: a first primary eave pole and a second primary eave pole, each having a first end portion configured to be pivotally connected with the fixed connector; and a first support eave pole corresponding to the first primary eave pole and a second support eave pole corresponding to the second primary eave pole, each of the first and second support eave poles having a first end portion configured to be pivotally connected with the at least one sliding connector and a second end portion configured to be pivotally connected with the corresponding first or second primary eave pole, wherein when the tent frame is unfolded, the first and second primary eave poles extend outwardly and upwardly with respect to the supporting pole, and form a first angle in-between.

Embodiment 2

The eave structure of embodiment 1, wherein the fixed connector comprises a first connector, and the at least one sliding connector comprises a second connector.

Embodiment 3

The eave structure of embodiment 2, wherein the first end portions of both the first and second support eave poles are configured to be pivotally connected with the second connector.

Embodiment 4

The eave structure of embodiment 1, wherein the at least one sliding connector comprises a second connector and a third connector disposed below the second connector.

Embodiment 5

The eave structure of embodiment 4, wherein the first end portion of the first support eave pole is configured to be pivotally connected with the second connector and the first end portion of the second support eave pole is configured to be pivotally connected with the third connector.

Embodiment 6

The eave structure of embodiment 1, wherein the first angle is substantially 90°.

Embodiment 7

The eave structure of embodiment 1, wherein the second end portion of each support eave pole is pivotally connected to an intermediate portion of a corresponding primary eave pole.

Embodiment 8

The eave structure of embodiment 1, wherein an insertion hole is formed at the second end portion of each primary eave pole and a cross pole is removably inserted into the insertion holes of corresponding primary eave poles of adjacent supporting poles.

Embodiment 9

The eave structure of embodiment 8, wherein the cross pole comprises a first segment and a second segment pivotally connected to each other.

Embodiment 10

An eave structure of a tent frame, wherein the tent frame comprises a supporting pole, the eave structure comprising: a fixed connector configured to be fixedly coupled with an upper end portion of the supporting pole; at least one sliding connector configured to be slidably coupled with the supporting pole and movable along the supporting pole below the fixed connector; a first primary eave pole and a second primary eave pole, each having a first end portion configured to be pivotally connected with the fixed connector; and a first support eave pole corresponding to the first primary eave pole and a second support eave pole corresponding to the second primary eave pole, each of the first and second support eave poles having a first end portion configured to be pivotally connected with the at least one sliding connector and a second end portion configured to be pivotally connected with the corresponding first or second primary eave pole, wherein when the tent frame is unfolded, the first and second primary eave poles extend outwardly and upwardly with respect to the supporting pole, and form a first angle of 90° in-between.

Embodiment 11

The eave structure of embodiment 10, wherein the fixed connector comprises a first connector and the at least one sliding connector comprises a second connector and a third connector below the second connector.

Embodiment 12

The eave structure of embodiment 10, wherein the first end portion of the first support eave pole is pivotally connected to the second connector and the first end portion of the second support eave pole is pivotally connected to the third connector.

Embodiment 13

The eave structure of embodiment 10, wherein an insertion hole is formed at the second end portion of each primary eave pole and a cross pole is removably inserted into the insertion holes of corresponding primary eave poles of adjacent supporting poles.

Embodiment 14

The eave structure of embodiment 13, wherein the cross pole comprises a first segment and a second segment pivotally connected to each other.

Embodiment 15

A tent frame, comprising: a plurality of supporting poles; a plurality of fixed connectors and a plurality of sliding connectors, wherein corresponding to each respective supporting pole in the plurality of supporting poles, a fixed connector in the plurality of fixed connectors is fixedly coupled with an upper end portion of the respective supporting pole, and at least one sliding connector in the plurality of sliding connectors is slidably coupled with the respective supporting pole and movable along the respective supporting pole below the fixed connector; a plurality of side pole units each coupled with two adjacent supporting poles through one or more of the fixed and sliding connectors at the two adjacent supporting poles; an upper frame coupled with the plurality of supporting poles by the plurality of fixed connectors and the plurality of sliding connectors or coupled with the plurality of side pole units or coupled with both; and two or more eave structures, each coupled with a supporting pole in a subset of the plurality of supporting poles through one or more of the fixed and sliding connectors at the supporting pole, wherein each eave structure comprises: a first primary eave pole and a second primary eave pole, each having a first end portion pivotally connected with the fixed connector at the supporting pole; and a first support eave pole corresponding to the first primary eave pole and a second support eave pole corresponding to the second primary eave pole, each of the first and second support eave poles having a first end portion pivotally connected with the at least one sliding connector and a second end portion pivotally connected with the corresponding first or second primary eave pole, wherein when the tent frame is unfolded, the first and second primary eave poles extend outwardly and upwardly with respect to the supporting pole and extend outwardly beyond the upper frame.

Embodiment 16

The tent frame of embodiment 15, further comprising: one or more cross poles, each disposed between two adjacent eave structures, and connected with the second end portions of the first primary eave poles of the two adjacent eave structures or connected with the second end portions of the second primary eave poles of the two adjacent eave structures.

Embodiment 17

The tent frame of embodiment 16, wherein an insertion hole is formed at the second end portion of each primary eave pole and each cross pole is removably inserted into the insertion holes of the corresponding primary eave poles.

Embodiment 18

The tent frame of embodiment 15, wherein the upper frame comprises: a hub; and a plurality of upper pole units, each disposed between the hub and a supporting pole in the plurality of supporting poles and comprising: a plurality of upper poles pivotally connected with each other, comprising a first upper pole adjacent the hub and a second upper pole adjacent the supporting pole, wherein the first upper pole has an end portion pivotally connected with the hub, and the second upper pole has an end portion pivotally connected with the fixed connector at the supporting pole; and an oblique pole having a first end portion pivotally connected the second upper pole and a second end portion pivotally connected with the at least one sliding connector at the supporting pole.

Embodiment 19

The tent frame of embodiment 15, wherein each side pole unit in the plurality of side pole units comprises one or more side pole pairs connected with each other, wherein: each side pole pair comprises first and second side poles crossly and pivotally connected with each other; and each of the first and second side poles adjacent a supporting pole has an end portion pivotally connected with the fixed or sliding connector at the supporting pole.

Embodiment 20

The tent frame of embodiment 19, wherein the upper frame comprises: a central pole; a fixed hub fixedly coupled with the central pole at a lower end thereof; a sliding hub slidably coupled with the central pole and movable along the central pole above the fixed hub; and a plurality of upper pole units, each disposed between the central pole and a side pole unit in the plurality of side pole units, wherein each upper pole unit comprises one or more upper pole pairs connected with each other; each upper pole pair comprises first and second upper poles crossly and pivotally connected with each other; each of the first and second upper poles adjacent the central pole has an end portion pivotally connected with the fixed or sliding hub at the central pole; and each of the first and second upper poles adjacent the side pole unit has an end portion pivotally connected with the first or second side pole of a corresponding side pole pair of the side pole unit.

Embodiment 21

The tent frame of embodiment 20, wherein each side pole unit in the plurality of side pole units comprises two side pole pairs, and each upper pole unit in the plurality of upper pole units comprises one upper pole pair.

Embodiment 22

The tent frame of embodiment 15, wherein a number of supporting poles and a number of eave structures are the same, and wherein each respective supporting pole in the plurality of supporting poles has a corresponding eave structure.

Embodiment 23

The tent frame of embodiment 15, wherein the plurality of side pole units each comprises a plurality of side poles pivotally connected to each other.

Embodiment 24

The tent frame of embodiment 15, wherein corresponding to each supporting pole in the subset of the plurality of supporting poles: the fixed connector comprises a first connector; the at least one sliding connector comprises a second connector; and the first end portions of both the first and second support eave poles are pivotally connected with the second connector.

Embodiment 25

The tent frame of embodiment 15, wherein corresponding to each supporting pole in the subset of the plurality of supporting poles: the fixed connector comprises a first connector; the at least one sliding connector comprises a second connector and a third connector disposed below the second connector; the first end portion of the first support eave pole is pivotally connected with the second connector; and the first end portion of the second support eave pole is pivotally connected with the third connector.

Embodiment 26

The tent frame of embodiment 15, wherein corresponding to each supporting pole in the subset of the plurality of supporting poles, the second end portion of each support eave pole For convenience in explanation and accurate definition in the appended claims, the terms "upper", "lower", "upwardly", "downwardly", and "outwardly" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A tent frame, comprising:

a plurality of supporting poles;

a plurality of fixed connectors and a plurality of sliding connectors, wherein corresponding to each respective supporting pole in the plurality of supporting poles, a fixed connector in the plurality of fixed connectors is fixedly coupled with an upper end portion of the respective supporting pole, and at least one sliding connector in the plurality of sliding connectors is slidably coupled with the respective supporting pole and movable along the respective supporting pole below the fixed connector;

a plurality of side pole units each coupled with two adjacent supporting poles through one or more of the fixed and sliding connectors at the two adjacent supporting poles;

an upper frame coupled with the plurality of supporting poles by the plurality of fixed connectors and the plurality of sliding connectors or coupled with the plurality of side pole units or coupled with both; and two or more eave structures, each coupled with a respective individual supporting pole in a subset of the plurality of supporting poles through one or more of the fixed and sliding connectors at the respective individual supporting pole, wherein each eave structure comprises:

a first primary eave pole and a second primary eave pole, each having a first end portion and a second end portion, wherein the first end portion of each of the first and second primary eave poles is pivotally connected with the fixed connector at the respective individual supporting pole, and the second end portion of the first primary eave pole, the second primary eave pole, or each of the first and second primary eave poles is formed with an insertion hole; and a first support eave pole corresponding to the first primary eave pole and a second support eave pole corresponding to the second primary eave pole, each of the first and second support eave poles having a first end portion pivotally connected with the at least one sliding connector at the respective individual supporting pole, and a second end portion pivotally connected with the corresponding first or second primary eave pole;

wherein when the tent frame is unfolded, the first and second primary eave poles extend outwardly with respect to the respective individual supporting pole and extend outwardly beyond the upper frame; and one or more cross poles, each disposed between two adjacent eave structures, and connected with the second end portions of the first primary eave poles of the two adjacent eave structures or connected with the second end portions of the second primary eave poles of the two adjacent eave structures, wherein each cross pole is removably inserted into the insertion holes of the corresponding primary eave poles.

2. The tent frame of claim 1, wherein the upper frame comprises:

a hub; and a plurality of upper pole units, each disposed between the hub and a supporting pole in the plurality of supporting poles and comprising:

a plurality of upper poles pivotally connected with each other, comprising a first upper pole adjacent the hub and a second upper pole adjacent the supporting pole, wherein the first upper pole has an end portion pivotally connected with the hub, and the second upper pole has an end portion pivotally connected with the fixed connector at the supporting pole; and an oblique pole having a first end portion pivotally connected the second upper pole and a second end portion pivotally connected with the at least one sliding connector at the supporting pole.

3. The tent frame of claim 1, wherein each side pole unit in the plurality of side pole units comprises one or more side pole pairs connected with each other, wherein:

each side pole pair comprises first and second side poles crossly and pivotally connected with each other; and each of the first and second side poles adjacent a supporting pole has an end portion pivotally connected with the fixed or sliding connector at the supporting pole.

4. The tent frame of claim 3, wherein the upper frame comprises:

a central pole;

a fixed hub fixedly coupled with the central pole at a lower end thereof;

a sliding hub slidably coupled with the central pole and movable along the central pole above the fixed hub; and a plurality of upper pole units, each disposed between the central pole and a side pole unit in the plurality of side pole units, wherein each upper pole unit comprises one or more upper pole pairs connected with each other;

each upper pole pair comprises first and second upper poles crossly and pivotally connected with each other;

each of the first and second upper poles adjacent the central pole has an end portion pivotally connected with the fixed or sliding hub at the central pole; and each of the first and second upper poles adjacent the side pole unit has an end portion pivotally connected with the first or second side pole of a corresponding side pole pair of the side pole unit.

5. The tent frame of claim 4, wherein each side pole unit in the plurality of side pole units comprises two side pole pairs, and each upper pole unit in the plurality of upper pole units comprises one upper pole pair.

6. The tent frame of claim 1, wherein a number of supporting poles and a number of eave structures are the same, and wherein each respective supporting pole in the plurality of supporting poles has a corresponding eave structure.

7. The tent frame of claim 1, wherein the plurality of side pole units each comprises a plurality of side poles pivotally connected to each other.

8. The tent frame of claim 1, wherein corresponding to each supporting pole in the subset of the plurality of supporting poles: the fixed connector comprises a first connector, and the at least one sliding connector comprises a second connector.

9. The tent frame of claim 8, wherein the first end portions of both the first and second support eave poles are configured to be pivotally connected with the second connector.

10. The tent frame of claim 8, wherein the at least one sliding connector further comprises a third connector disposed below the second connector, wherein the first end portion of the first support eave pole is configured to be pivotally connected with the second connector and the first end portion of the second support eave pole is configured to be pivotally connected with the third connector.

11. The tent frame of claim 1, wherein corresponding to each respective individual supporting pole in the subset of the plurality of supporting poles, the second end portion of each support eave pole is pivotally connected to an intermediate portion of a corresponding primary eave pole.

12. The tent frame of claim 1, wherein corresponding to each respective individual supporting pole in the subset of the plurality of supporting poles, the first and second primary eave poles form a first angle in-between when the tent frame is unfolded, wherein the first angle is substantially 90°.

13. A tent frame, comprising:

a plurality of supporting poles;

a plurality of fixed connectors and a plurality of sliding connectors, wherein corresponding to each respective supporting pole in the plurality of supporting poles, a fixed connector in the plurality of fixed connectors is fixedly coupled with an upper end portion of the respective supporting pole, and at least one sliding connector in the plurality of sliding connectors is slidably coupled with the respective supporting pole and movable along the respective supporting pole below the fixed connector;

a plurality of side pole units each coupled with two adjacent supporting poles through one or more of the fixed and sliding connectors at the two adjacent supporting poles;

an upper frame coupled with the plurality of supporting poles by the plurality of fixed connectors and the plurality of sliding connectors or coupled with the plurality of side pole units or coupled with both; and two or more eave structures, each coupled with a supporting pole in a subset of the plurality of supporting poles through one or more of the fixed and sliding connectors at the supporting pole, wherein each eave structure comprises:

a first primary eave pole and a second primary eave pole, each having a first end portion pivotally connected with the fixed connector at the supporting pole; and a first support eave pole corresponding to the first primary eave pole and a second support eave pole corresponding to the second primary eave pole, each of the first and second support eave poles having a first end portion pivotally connected with the at least one sliding connector and a second end portion pivotally connected with the corresponding first or second primary eave pole, wherein corresponding to each supporting pole in the subset of the plurality of supporting poles:

the fixed connector comprises a first connector;

the at least one sliding connector comprises a second connector and a third connector disposed below the second connector;

the first end portion of the first support eave pole is pivotally connected with the second connector;

the first end portion of the second support eave pole is pivotally connected with the third connector; and when the tent frame is unfolded, the first and second primary eave poles extend outwardly with respect to the supporting pole and extend outwardly beyond the upper frame.

14. The tent frame of claim 13, wherein the upper frame comprises:

a hub; and a plurality of upper pole units, each disposed between the hub and a supporting pole in the plurality of supporting poles and comprising:

a plurality of upper poles pivotally connected with each other, comprising a first upper pole adjacent the hub and a second upper pole adjacent the supporting pole, wherein the first upper pole has an end portion pivotally connected with the hub, and the second upper pole has an end portion pivotally connected with the fixed connector at the supporting pole; and an oblique pole having a first end portion pivotally connected the second upper pole and a second end portion pivotally connected with the at least one sliding connector at the supporting pole.

15. The tent frame of claim 13, wherein each side pole unit in the plurality of side pole units comprises one or more side pole pairs connected with each other, wherein:

each side pole pair comprises first and second side poles crossly and pivotally connected with each other; and each of the first and second side poles adjacent a supporting pole has an end portion pivotally connected with the fixed or sliding connector at the supporting pole.

16. The tent frame of claim 15, wherein the upper frame comprises:

a central pole;

a fixed hub fixedly coupled with the central pole at a lower end thereof;

a sliding hub slidably coupled with the central pole and movable along the central pole above the fixed hub; and a plurality of upper pole units, each disposed between the central pole and a side pole unit in the plurality of side pole units, wherein each upper pole unit comprises one or more upper pole pairs connected with each other;

each upper pole pair comprises first and second upper poles crossly and pivotally connected with each other;

each of the first and second upper poles adjacent the central pole has an end portion pivotally connected with the fixed or sliding hub at the central pole; and each of the first and second upper poles adjacent the side pole unit has an end portion pivotally connected with the first or second side pole of a corresponding side pole pair of the side pole unit.

17. The tent frame of claim 13, wherein a number of supporting poles and a number of eave structures are the same, and wherein each respective supporting pole in the plurality of supporting poles has a corresponding eave structure.

18. The tent frame of claim 13, wherein the plurality of side pole units each comprises a plurality of side poles pivotally connected to each other.

19. The tent frame of claim 13, wherein corresponding to each supporting pole in the subset of the plurality of supporting poles, the second end portion of each support eave pole is pivotally connected to an intermediate portion of a corresponding primary eave pole.

20. The tent frame of claim 13, wherein corresponding to each supporting pole in the subset of the plurality of supporting poles, the first and second primary eave poles form a first angle in-between when the tent frame is unfolded, wherein the first angle is substantially 90°.

* * * * *